US005583623A

United States Patent [19]

Bartholmae et al.

[11] Patent Number: 5,583,623

[45] Date of Patent: Dec. 10, 1996

[54] METHOD AND APPARATUS FOR ATTACHING AN IMAGE RECEIVING MEMBER TO A TRANSFER DRUM

[75] Inventors: Jack N. Bartholmae, Duluth; E. Neal Tompkins, Atlanta, both of Ga.

[73] Assignee: T/R Systems, Norcross, Ga.

[21] Appl. No.: 468,365

[22] Filed: Jun. 6, 1995

Related U.S. Application Data

[63] Continuation of Ser. No. 141,273, Dec. 6, 1993, Pat. No. 5,459,560, which is a continuation-in-part of Ser. No. 954, 786, Sep. 30, 1992, Pat. No. 5,276,490.

[51] Int. Cl.[6] ..... G03G 15/16

[52] U.S. Cl. ..... 355/274; 355/271; 355/272

[58] Field of Search ..... 355/271–275, 355/277

[56] References Cited

U.S. PATENT DOCUMENTS

| | | | |
|---|---|---|---|
| 3,976,370 | 8/1976 | Goel et al. | 355/271 X |
| 5,168,290 | 12/1992 | Tanaka et al. | 355/271 X |
| 5,249,023 | 9/1993 | Miyashiro et al. | 355/275 X |
| 5,287,163 | 2/1994 | Miyashiro et al. | 355/274 X |
| 5,390,012 | 2/1995 | Miyashiro et al. | 355/273 |
| 5,398,107 | 3/1995 | Bartholmae et al. | 355/273 |
| 5,402,218 | 3/1995 | Miyashiro et al. | 355/274 |
| 5,442,429 | 8/1995 | Bartholmae et al. | 355/274 X |

*Primary Examiner*—Matthew S. Smith
*Attorney, Agent, or Firm*—Gregory M. Howison

[57] ABSTRACT

A buried electrode drum (48) includes a rigid core (10) over which a controlled durometer layer (12) is disposed. On the surface of the controlled durometer layer (12) is disposed a buried electrode layer (14), having electrodes (16) disposed therein along the longitudinal axis of the drum (48). The electrode layer (14) is covered by a controlled resistivity layer (18). The controlled resistivity layer (18) is operable to be contacted on the surface thereof by an electrode (24) to allow a voltage to be transferred to the underlying electrodes (16) and therefrom along the longitudinal axis of the drum (48). Various electrodes can be disposed about the peripheral edge of the drum (48) to allow any pattern to be formed on the surface of the drum (48).

7 Claims, 18 Drawing Sheets

METHOD AND APPARATUS FOR ATTACHING AN IMAGE RECEIVING MEMBER TO A TRANSFER DRUM

CROSS-REFERENCE TO RELATED APPLICATION

This is a continuation of U.S. patent application Ser. No. 08/141,273, now U.S. Pat. No. 5,459,560, filed Dec. 6, 1993, and entitled "Buried Electrode Drum for an Electrophotographic Print Engine with Controlled Resistivity Layer," which is a continuation-in-part of U.S. patent application Ser. No. 07/954,786, now U.S. Pat. No. 5,276,490, filed Sep. 30, 1992, and entitled "Buried Electrode Drum for an Electrophotographic Print Engine."

BACKGROUND OF THE INVENTION

In electrophotographic equipment, it is necessary to provide various moving surfaces which are periodically charged to attract toner particles and discharged to allow the toner particles to be transferred. At present, three general approaches have been embodied in products in the marketplace with respect to the drums. In a first method, the conventional insulating drum technology is one technology that grips the paper for multiple transfers. A second method is the semi-conductive belt that passes all the toner to the paper in a single step. The third technology is the single transfer to paper multi-pass charge, expose and development approach.

Each of the above approaches has advantages and disadvantages. The conventional paper drum technology has superior image quality and transfer efficiency. However, hardware complexity (e.g., paper gripping, multiple coronas, etc.), media variability and drum resistivity add to the cost and reduce the reliability of the equipment. By comparison, the single transfer paper-to-paper system that utilizes belts has an advantage of simpler hardware and more reliable paper handling. However, it suffers from reduced system efficiency and the attendant problems with belt tracking, belt fatigue and handling difficulties during service. Furthermore, it is difficult to implement the belt system to handle multi-pass to paper configuration for improved efficiency and image quality. The third technique, the single transfer-to-paper system, is operable to build the entire toner image on the photoconductor and then transfer it. This technique offers simple paper handling, but at the cost of complex processes with image quality limitations and the requirement that the photoconductor surface be as large as the largest image.

SUMMARY OF THE INVENTION

The present invention disclosed and claimed herein comprises an electrophotographic print engine with a transfer mechanism that is operable to transfer an image from a photoconductor member to a flexible image receiving member. The transfer mechanism includes a rotating support member having a substantially continuous surface for carrying the flexible receiving member on the surface thereof. The support member has a electrostatic surface disposed on the surface of the support member. The flexible image receiving member will electrostatically adhere to the electrostatic surface when the voltage across the electrostatic surface is at a voltage greater than or equal to a predetermined gripping voltage. The photoconductor member is disposed at a reference voltage level and a transfer nip is formed between the photoconductor member and the electrostatic surface such that the flexible image receiving member can be disposed in the transfer nip. A primary voltage source is provided that is operable to apply a primary voltage across the electrostatic surface and the flexible image receiving member at the transfer nip and relative to the reference voltage level that is equal to or greater than the sum of the gripping voltage and at least a transfer voltage. The transfer voltage is a voltage level that is the voltage necessary to transfer toner across the transfer nip from the photoconductor member to the flexible image member. The primary voltage source operates in conjunction with the electrostatic surface to allow the voltage across the electrostatic surface and the flexible image receiving member to decay after passing through the transfer nip from the primary voltage level to a voltage level greater than or equal to the gripping voltage prior to entering the transfer nip again during a subsequent transfer process.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
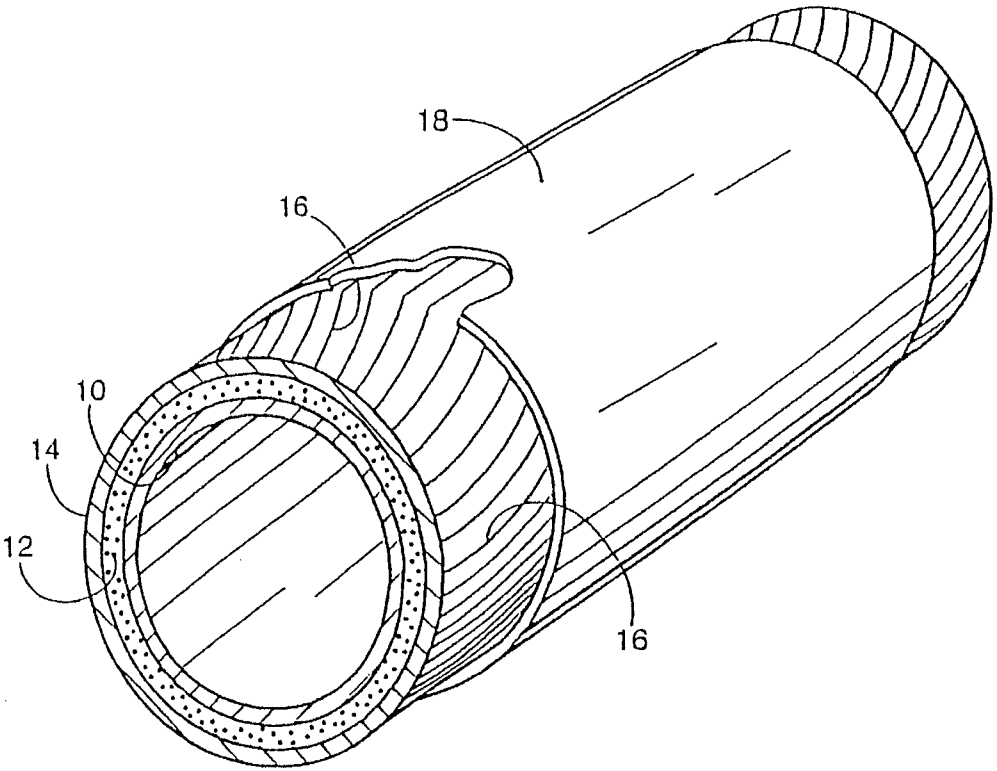
FIG. 1 illustrates a perspective view of the buried electrode drum of the present invention.

Referring now to FIG. 1, there is illustrated a perspective view of the buried electrode drum of the present invention. The buried electrode drum is comprised of an inner core 10 that provides a rigid support structure. This inner core 10 is comprised of an aluminum tube core of a thickness of approximately 2 millimeters (mm). The next outer layer is comprised of a controlled durometer layer 12 which is approximately 2–3 mms and fabricated from silicon foam or rubber. This is covered with an electrode layer 14, comprised of a plurality of longitudinally disposed electrodes 16, the electrodes being disposed a distance of 0.10 inch apart, center line to center line, approximately 0.1 mm. A controlled resistivity layer 18 is then disposed over the electrode layer to a thickness of approximately 0.15 mm, which layer is fabricated from carbon filled polymer material.

Figure 2:
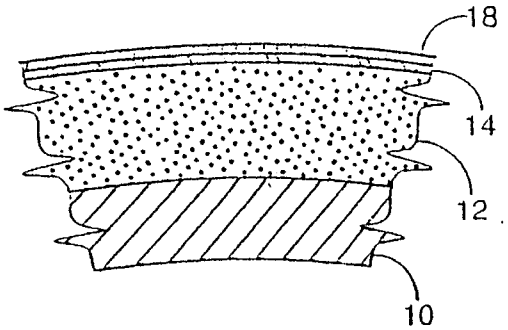
FIG. 2 illustrates a selected cross section of the drum of FIG. 1.

Referring now to FIG. 2, there is illustrated a more detailed cross-sectional diagram of the buried electrode drum. It can be seen that at the end of the buried electrode drum, the electrodes 16 within electrode layer 14 are disposed a predetermined distance apart. However, the portion of the electrodes 16, proximate to the ends of the drum on either side thereof are "skewed" relative to the longitudinal axis of the drum. As will be described hereinbelow, this is utilized to allow access thereto.

Figure 3:
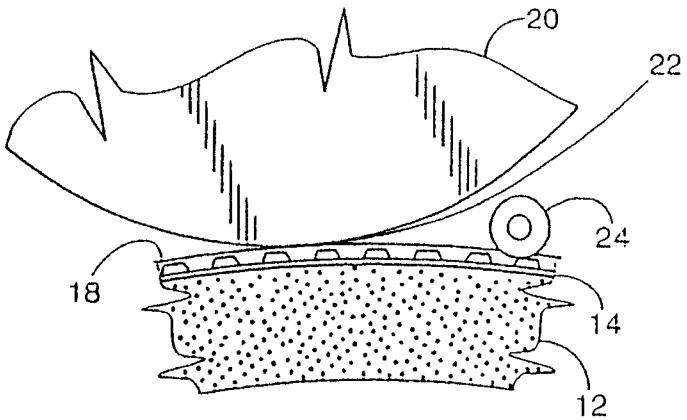
FIG. 3 illustrates the interaction of the photoconductor drum and the buried electrode drum of the present invention.

Referring now to FIG. 3, there is illustrated a side view of the buried electrode drum illustrating its relationship with a photoconductor drum 20. The photoconductor drum 20 is operable to have an image disposed thereon. In accordance with conventional techniques, a latent image is first disposed on the photoconductor drum 20 and then transferred to the surface of the buried electrode drum in an electrostatic manner. Therefore, the appropriate voltage must be present on the surface at the nip between the photoconductor drum 20 and the buried electrode drum. This nip is defined by a reference numeral 22.

A roller electrode 24 is provided that is operable to contact the upper surface of the buried electrode drum at the outer edge thereof, such that it is in contact with the controlled resistivity layer 18. Since the electrodes 16 are skewed, the portion of the electrode 16 that is proximate to the roller electrode 24 and the portion of the electrode 16 that is proximate to the nip 22 on the longitudinal axis of the photoconductor drum 20 are associated with the same electrode 16, as will be described in more detail hereinbelow.

Figure 4:
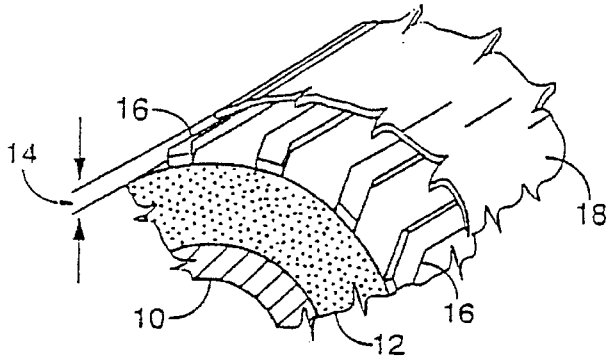
FIG. 4 illustrates a cutaway view of the electrodes at the edge of the drum.

Referring now to FIG. 4, there is illustrated a cutaway view of the buried electrode drum. It can be seen that the buried electrodes 16 are typically formed by etching a pattern on the outer surface of the controlled durometer layer 12. Typically, the electrodes 16 are initially formed by disposing a layer of thin, insulative polymer, such as Mylar, over the surface of the controlled durometer layer 12. An electrode structure is then bonded or deposited on the surface of the Mylar layer. In the bonded configuration, the electrode pattern is predetermined and disposed in a single sheet on the Mylar. In the deposited configuration, a layer of insulative material is disposed down and then patterned and etched to form the electrode structure. Although a series of parallel lines is illustrated, it should be understood that any pattern could be utilized to give the appropriate voltage profile, as will be described in more detail hereinbelow.

Figure 5A:
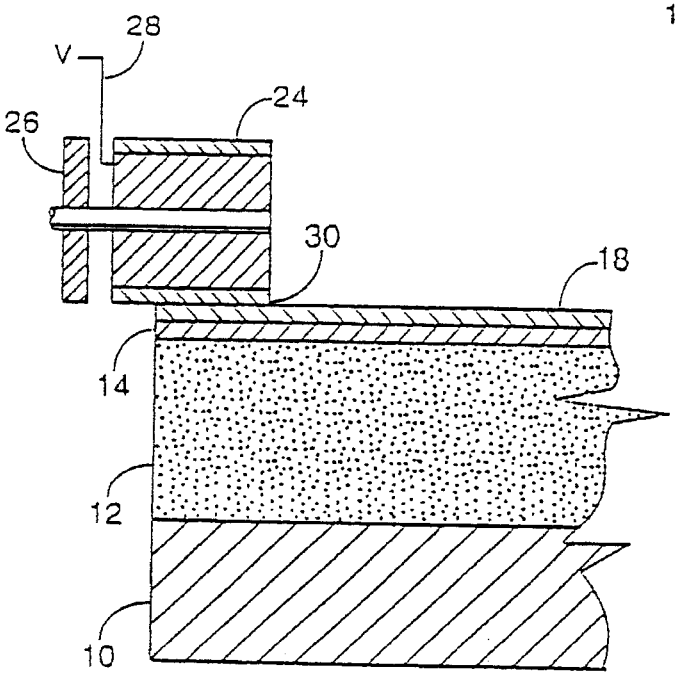
FIGS. 5*a* and 5*b* illustrate alternate techniques for electrifying the surface of the drum.
Figure 5B:
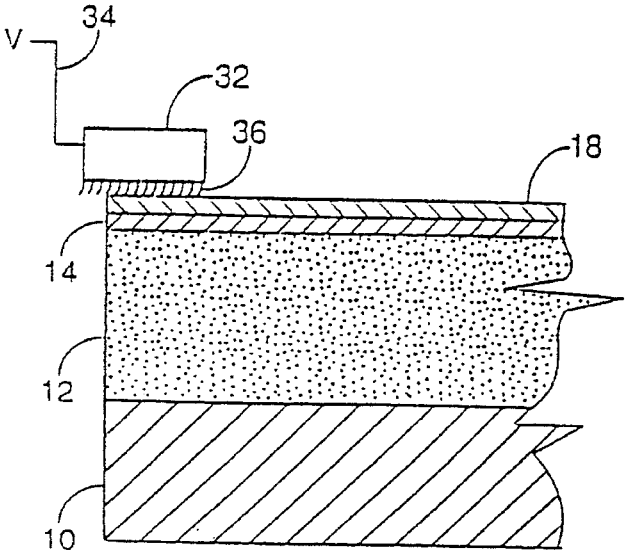

Referring now to FIGS. 5*a* and 5*b*, there are illustrated two techniques for contacting the electrodes. In FIG. 5*a*, a roller electrode is utilized comprising a cylindrical roller 24 that is pivoted on an axle 26. A voltage V is disposed through a line 28 to contact the roller 24. The roller 24 is disposed on the edge of the buried electrode drum such that a portion of it contacts the upper surface of the controlled resistivity layer 18 and forms a nip 30 therewith. At the nip 30, a conductive path is formed from the outer surface of the roller electrode 24 through the controlled resistivity layer 18 to electrode 16 in the electrode layer 14. In this manner, a conductive path is formed. The electrodes 16 in the electrode layer 14, as will be described hereinbelow, are operable to provide a low conductivity path along the longitudinal axis of the buried electrode drum to evenly distribute the voltage along the longitudinal axis.

FIG. 5*b* illustrates a configuration utilizing a brush 32. The brush 32 is connected through the voltage V through a line 34 and has conductive bristles 36 disposed on one surface thereof for contacting the outer surface of the control resistivity layer 18 on the edge of the buried electrode drum. The bristles 36 conduct current to the surface of the controlled resistivity layer 18 and therethrough to the electrodes 16 in the electrode layer 14. This operates identical to the system of FIG. 5*a*, in that the electrode 16 in the electrode layer 14 distributes the voltage along the longitudinal axis of the buried electrode drum.

Figure 6A:
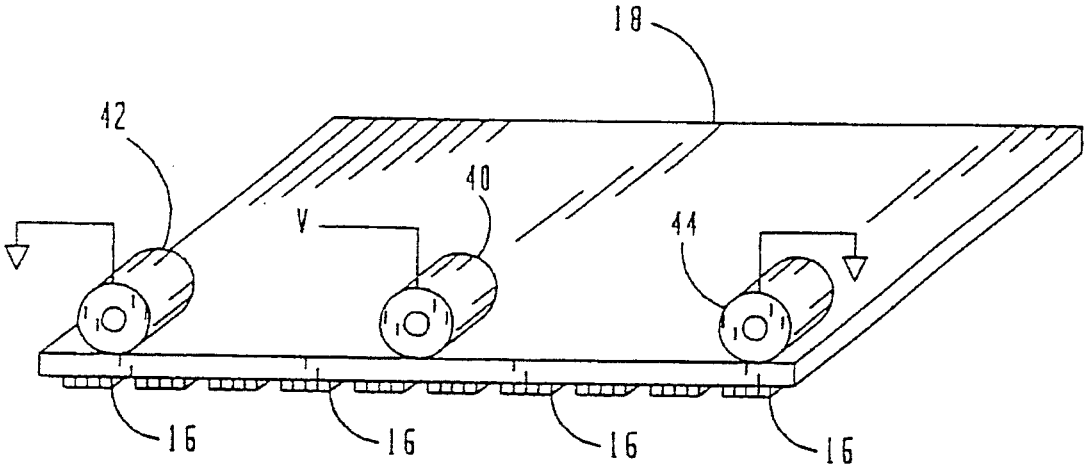
FIGS. 6*a*–6*c* illustrate the distributed resistance of the buried electrode drum of the present invention.
Figure 6B:
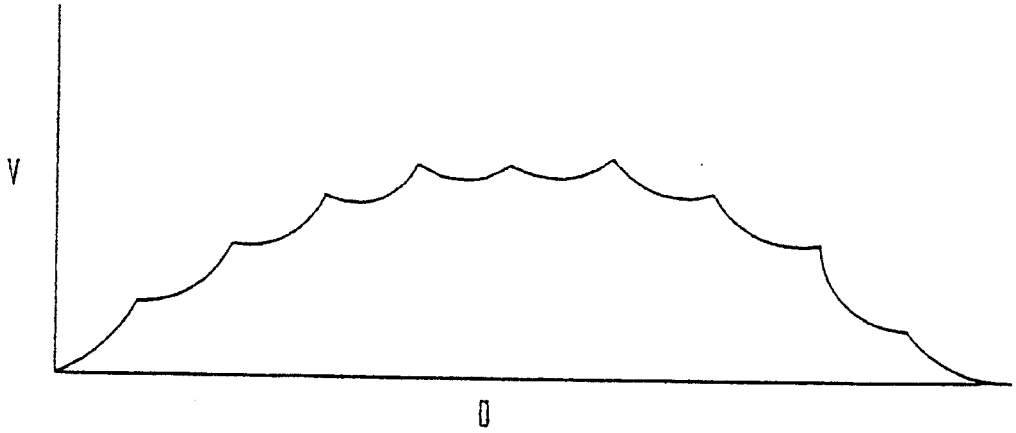
Figure 6C:
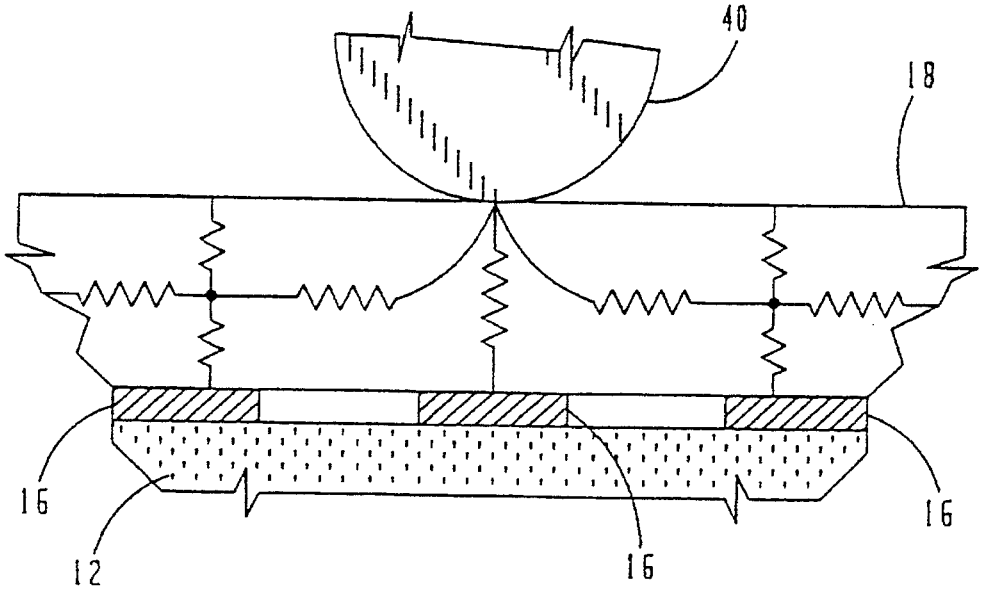

Referring now to FIGS. 6a–6c, the distribution of voltage along the surface of the electrode layer 14 will be described in more detail. The buried electrode drum is illustrated in a planar view with the electrode layer "unwrapped" from the controlled durometer layer 12 for simplification purposes. Along the length of the controlled resistivity layer 18 are disposed three electrode rollers, an electrode roller 40 connected to the positive voltage V, an electrode roller 42 connected to a ground potential and an electrode roller 44 connected to a ground potential. The electrode roller 40 is operable to dispose a voltage V on the electrode directly therebeneath, which voltage is conducted along the longitudinal axis of the drum at the portion of the controlled resistivity layer 18 overlying the electrode 16 having the highest voltage thereon. Since the electrode rollers 42 and 44 have a ground potential, current will flow through the controlled resistivity layer 18 to each of the electrode rollers 42 and 44 with a corresponding potential drop, which potential drop decreases in a substantially linear manner. However, at each electrode disposed between the roller 40 and the rollers 42 and 44, the potential at that electrode 16 will be substantially the same along the longitudinal axis of the buried electrode drum. In this configuration, therefore, the electrode roller 40 disposed at the edge of the buried electrode drum is operable to form a potential at the edge of the buried electrode drum that is reflected along the surface of the buried electrode drum in accordance with the pattern formed by the underlying electrode 16. Therefore, the roller electrode 40, in conjunction with the electrode 16, act as individual activatable charging devices, which devices can be arrayed around the drum merely by providing additional electrode rollers at various potentials, although only one voltage profile is illustrated, many segments could be formed to provide any number of different voltage profiles. Additionally, local extremum voltages occur between electrode strips 16 and overall extremum voltages occur between rollers 40, 42 and 44.

FIG. 6b illustrates the potential along the length of the controlled resistivity layer 18. It can be seen that the highest potential is at the electrode 16 underlying the electrode roller 40, since this is the highest potential. Each adjacent electrode 16 has a decreasing potential disposed thereon, with the potential decreasing down to a zero voltage at each of the electrode rollers 42 and 44. The voltage profile shown in FIG. 6b shows that there is some lower voltage disposed between the two electrodes, due to the resistivity of the controlled resistivity layer 18.

FIG. 6c illustrates a detailed view of the electrode roller 40 and the resistance associated therewith. There is a distributed resistance directly from the electrode roller 40 to the one of the electrodes 16 directly therebeneath. A second distributive resistance exists between the electrode roller 40 and the adjacent electrodes 16. However, each of the adjacent electrodes 16 also has a resistance from the surface thereof upward to the upper surface of the controlled resistivity layer 18. Since the resistance along the longitudinal axis of the buried electrode drum with respect to each of the electrodes 16 is minimal, the potential at the surface of the controlled resistivity layer 18 overlying each of the electrodes 16 will be substantially the same. It is only necessary for a resistive path to be established between the surface of the roller 40 and each of the electrodes. This current path is then transmitted along the electrode 16 to the upper surface of the controlled resistivity layer 18 in accordance with the pattern formed by buried electrodes 16.

Figure 7A:
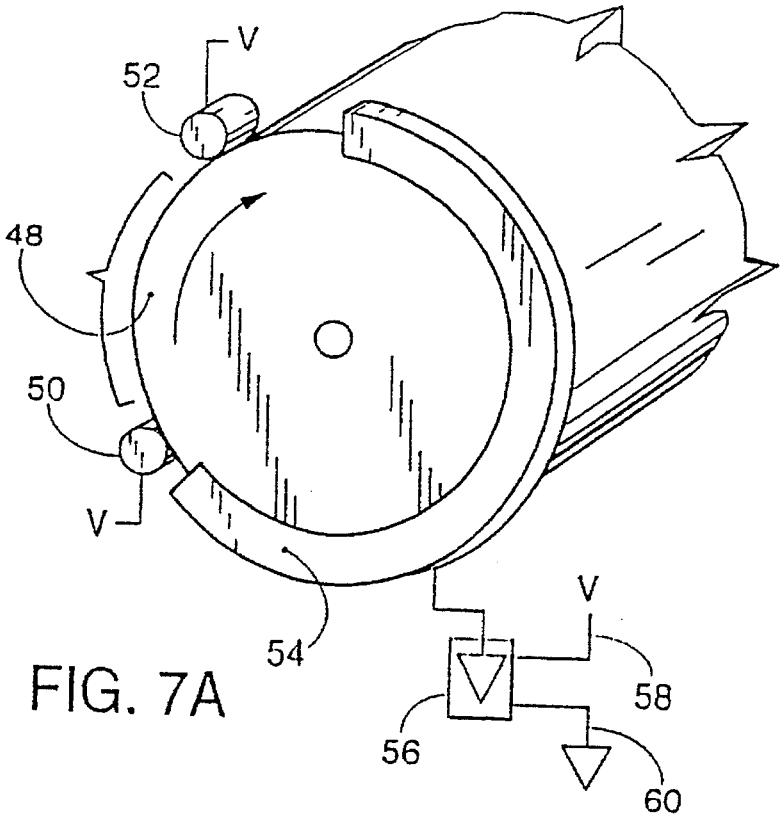
FIGS. 7*a* and 7*b* illustrate the arrangement of the electrifying rollers to the edge of the drum.
Figure 7B:
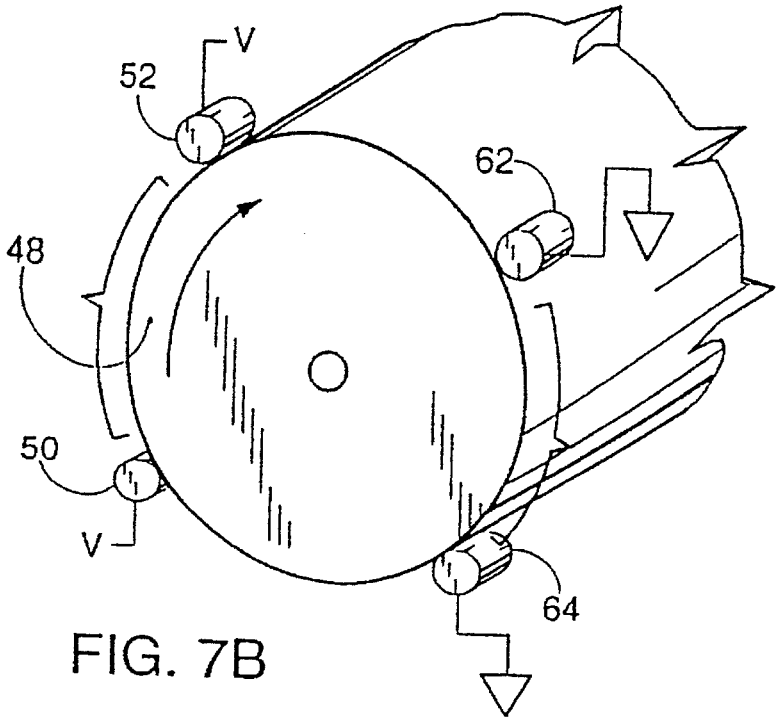

Referring now to FIGS. 7a and 7b, there are illustrated perspective views of two embodiments for configuring the rollers. In FIG. 7a, the buried electrode drum, referred to by a reference numeral 48, has two rollers 50 and 52 disposed at the edges thereof and a predetermined distance apart. The distance between the rollers 50 and 52 is a portion of the buried electrode drum 48 that contacts the photoconductor drum. A voltage V is disposed on each of the rollers 50 and 52 such that the voltage on the surface of the drum 48 is substantially equal over that range. A brush 54 is disposed on substantially the remaining portion of the circumference at the edge of the drum 48 such that conductive bristles contact all of the remaining surface at the edge of the drum 48. The electrode brush 54 is connected through a multiplexed switch 56 to either a voltage V on a line 58 or a ground potential on a line 60. The switch 56 is operable to switch between these two lines 58 and 60. In this configuration, one mode could be provided wherein the drum 48 was utilized as a transfer drum such that multiple images could be disposed on the drum in a multicolor process. However, when transfer is to occur, the switch 56 selects the ground potential 60 such that when the drum rotates past the electrode roller 52, the voltage is reduced to ground potential at the electrodes 16 that underlie the brush 54.

FIG. 7b illustrates the drum 48 and rollers 50 and 52 for disposing the positive voltage therebetween. However, rather than a brush 54 that is disposed around the remaining portion at the edge of the drum 48, two ground potential electrode rollers 62 and 64 are provided, having a transfer region disposed therebetween. Therefore, an image disposed on the buried electrode drum 48 can be removed from the portion of the line between rollers 62 and 64, since this region is at a ground potential.

Figure 8:
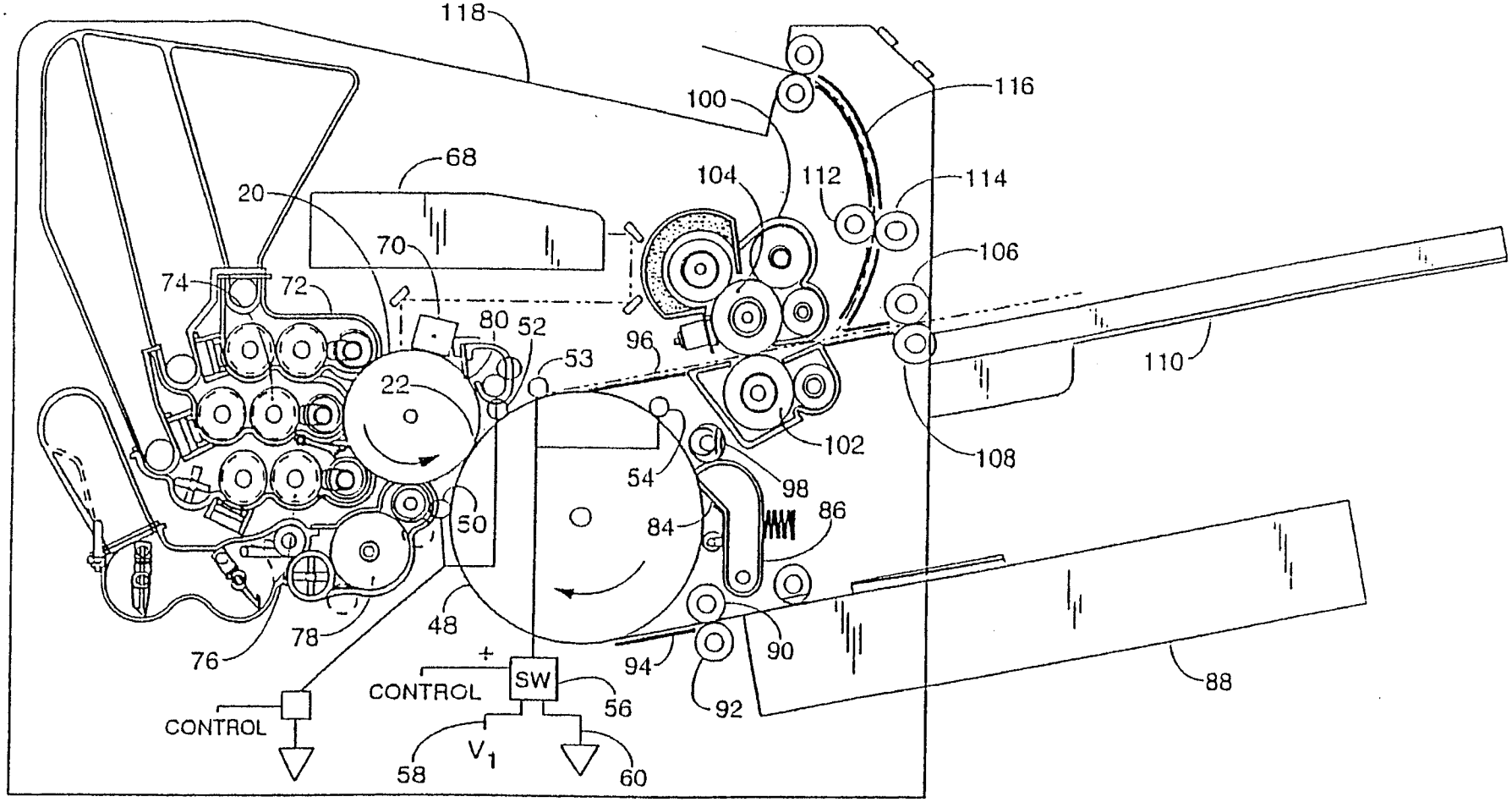
FIG. 8 illustrates a side view of a multi-pass-to-paper electrophotographic print engine utilizing the buried electrode drum.

Referring now to FIG. 8, there is illustrated a side view of a multi-pass-to-paper print engine. The print engine includes an imaging device 68 that is operable to generate a latent image on the surface of the PC drum 20. The PC drum 20 is disposed adjacent the buried electrode drum 48 with the contact thereof provided at the nip 22. Supporting brackets [not shown] provide sufficient alignment and pressure to form the nip 22 with the correct pressure and positioning. The nip 22 is formed substantially midway between the rollers 50 and 52, which rollers 50 and 52 are disposed at the voltage V. A scorotron 70 is provided for charging the surface of the photoconductor drum 20, with three toner modules, 72, 74 and 76 provided for a three-color system, this being conventional. Each of the toner modules 72, 74 and 76, are disposed around the periphery of the photoconductor drum 20 and are operable to introduce toner particles to the surface of the photoconductor drum 20 which, when a latent image passes thereby, picks up the toner particles. Each of the toner modules 72–76 is movable relative to the surface of the photoconductor drum 20. A fourth toner module 78 is provided for allowing black and white operation and also provides a fourth color for four color printing. Each of the toner modules 72–78 has a reservoir associated therewith for containing toner. A cleaning blade 80 is provided for cleaning excess toner from the surface of the photoconductor drum 20 after transfer thereof to the buried electrode drum 48. In operation, a three color system requires three exposures and three transfers after development of the exposed latent images. Furthermore, the modules 72–76 are connected together as a single module for ease of use.

The buried electrode drum 48 has two rollers 53 and 54 disposed on either side of a pick up region, which rollers 53 and 54 are disposed at the positive potential $V_1$ by switch 56 during the transfer operation. A cleaning blade 84 and waste container 86 are provided on a cam operated mechanism 88 such that cleaning blade 84 can be moved away from the surface of the buried electrode drum 48 during the initial transfer process. In the first transfer step, paper (or similar transfer medium) is disposed on the surface of the buried electrode drum 48 and the surface of drum 48 disposed at the positive potential V, and also for the second and third pass. After the third pass, the now complete multi-layer image will have been transferred onto the paper on the surface of the buried electrode drum 48.

The paper is transferred from a supply reservoir 88 through a nip formed by two rollers 90 and 92. The paper is then transferred to a feed mechanism 94 and into adjacent contact with the surface of the drum 48 prior to the first transfer step wherein the first layer of the multi-layer image is formed. After the last layer of the multi-layer image is formed, the rollers 53 and 54 are disposed at ground potential and then the paper and multi-layer image are then rotated around to a stripper mechanism 96 between rollers 53 and 54. The stripper mechanism 96 is operable to strip the paper from the drum 48, this being a conventional mechanism. The stripped paper is then fed to a fuser 100. Fuser 100 is operable to fuse the image in between two fuse rollers 102 and 104, one of which is disposed at an elevated temperature for this purpose. After the fusing operation, the paper is feed to the nip of two rollers 106 and 108, for transfer to a holding plate 110, or to the nip between two rollers 112 and 114 to be routed along a paper path 116 to a holding plate 118.

Figure 9:
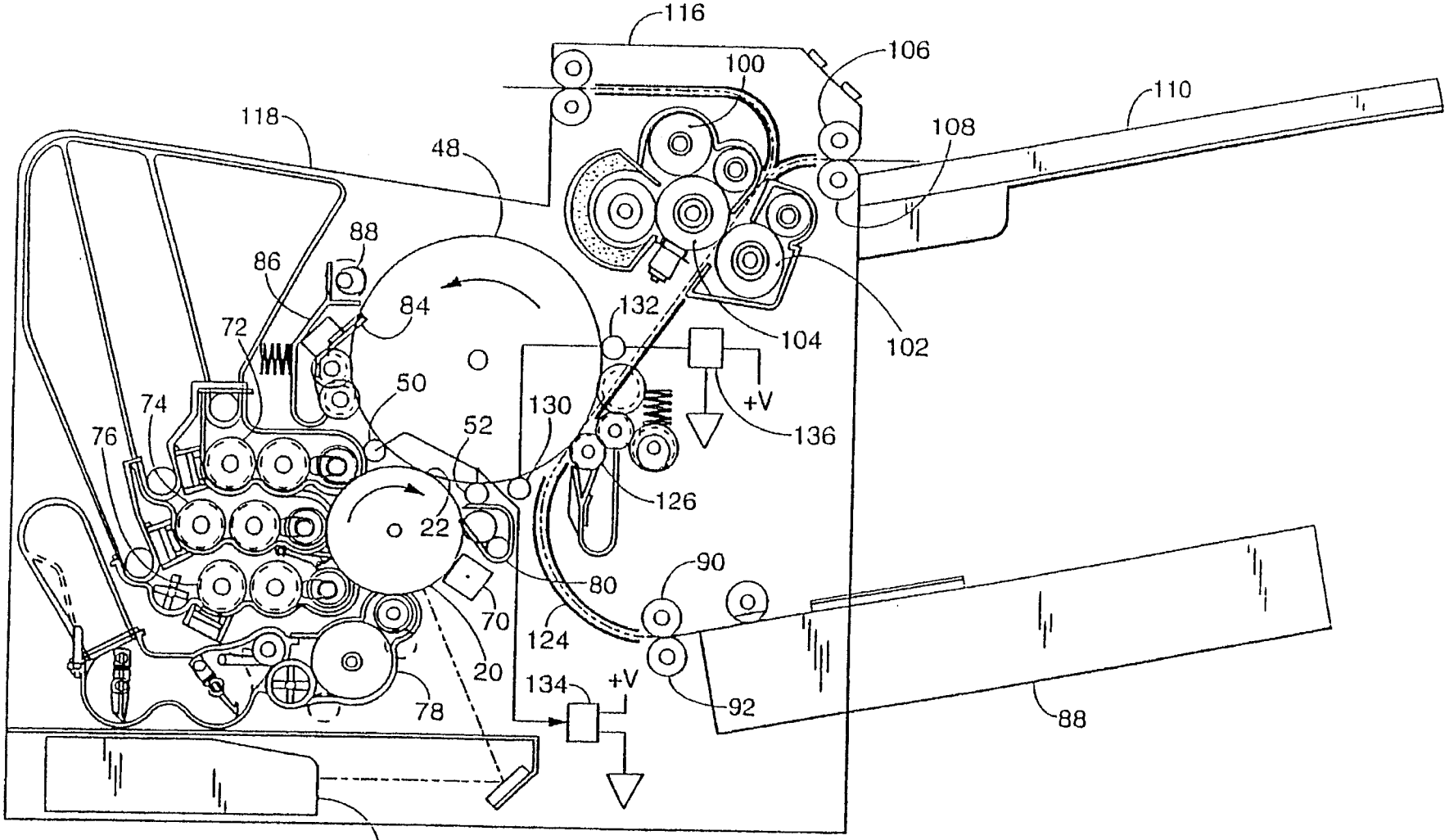
FIG. 9 illustrates a cross section of a single pass-to-paper print engine utilizing the varied electrode drum.

Referring now to FIG. 9, there is illustrated a side view of an intermediate transfer print engine. In this system, the three layers of the image are first disposed on the buried electrode drum 48 and then, after formation thereof, transferred to the paper. Initially, the surface of the drum is disposed at a positive potential by rollers 50 and 52 in the region between rollers 50 and 52. During the first pass, the first exposure is made, toner from one of the toner modules disposed on the latent image and then the latent image transferred to the actual surface of the buried electrode drum 48. During the second pass, a third toner is utilized to form a latent image and this image transferred to the drum 48. During the third pass, the third layer of the image is formed as a latent image using the second toner, which latent image is then transferred over the previous two images on the drum 48 to form the complete multilayer image.

After the image is formed, paper is fed from the supply reservoir 88 through the nip between rollers 90 and 92 along a paper path 124 between a nip formed by a roller 126 and the drum 48. The roller 126 is moved into contact with the drum 48 by a cam operation. The paper is moved adjacent to the drum 48 and thereafter into the fuser 100. During transfer of the image to the paper, two rollers 130 and 132 are provided on either side of the nip formed between the roller 126 and the drum 48. The two roller pairs 50,52 and 130,132 are operable to be disposed at a positive voltage by multiplex switches or relays 134 and 136, respectively, during the initial image formation procedure. During transfer to the paper, the roller pair 130,132 is disposed at ground voltage along with switch 136. However, it should be understood that these voltages could be a negative voltage to actually repulse the image from the surface of the drum 48.

Figure 10:
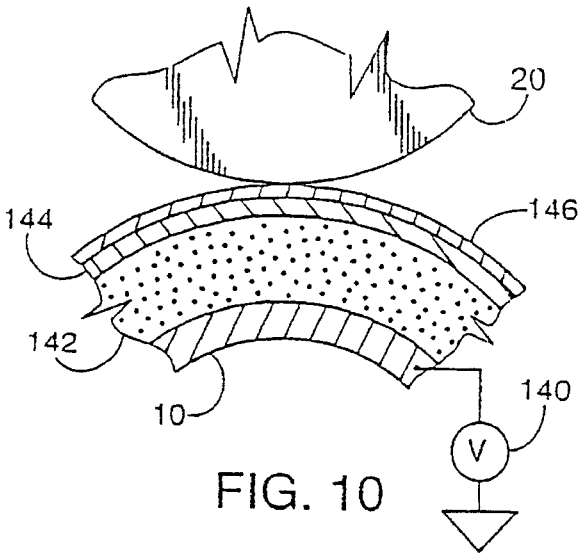
FIG. 10 illustrates an alternate embodiment of the overall construction of the drum assembly.

Referring now to FIG. 10, there is illustrated an alternate embodiment of the overall construction of the drum assembly. The aluminum support layer 10 comprises the conductive layer in this embodiment, which aluminum core 10 is attached to a voltage supply 140. The voltage supply 140 provides the gripping and transfer function, as will be described hereinbelow. The voltage supply 140 is applied such that it provides a uniform application of the voltage from the voltage supply 140 to the underside of a resilient layer 142. The resilient layer 142 is a conductive resilient layer with a volume resistivity under $10^{10}$ Ohm-cm. The layer 142 is fabricated from carbon filled elastomer or material such as butadiene acrylonitrile. The thickness of the layer 142 is approximately 3 mm. Overlying the resilient layer 142 is a controlled resistivity layer 144 which is composed of a thin dielectric layer of material with a thickness of between 50 and 100 microns. The layer 144 has a nonlinear relationship between the discharge (or relaxation) time and the applied voltage such that, as the voltage increases, the discharge time changes as a function thereof. Overlying the layer 144 is a layer of support material 146, which is typically paper. The photoconductor drum 20 contacts the paper 146.

Figure 11:
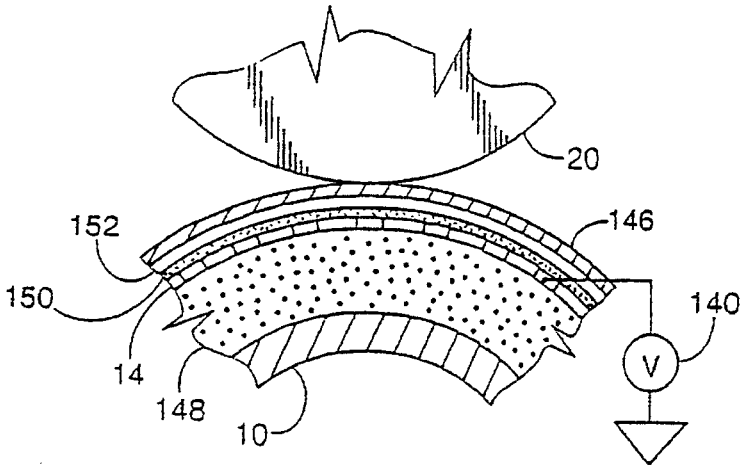
FIG. 11 illustrates another embodiment wherein a resilient layer of the insulating material is disposed over the aluminum core with electrodes disposed on the surface thereof.

Referring now to FIG. 11, there is illustrated another embodiment wherein a resilient layer 148 of an insulating material comprised of Neoprene is disposed over the aluminum core 10 with electrodes 14 disposed on the surface thereof. The electrodes 14 are disposed in a layer, each of the electrodes 14 comprised of an array of conductors separated by a predetermined distance. The conductors 14 are covered by a controlled resistivity layer 152, similar to the controlled resistivity layer 144 in FIG. 10, the gripping layer 150 covered by a controlled resistivity layer with a surface resistivity of between $10^6$–$10^{10}$ Ohm/sq. The controlled resistivity layer 152 is fabricated from FLEX 200 and has a thickness of 75 microns. This is covered by the support layer 146. The distance between the electrodes 14 is defined by the following equation:

$$v_d = \frac{i_d \times s \times r}{4w} \tag{1}$$

where $v_d$ is the allowable voltage droop between electrodes, $i_d$ is the toner transfer current;

s is the spacing of the electrodes;

r is the sum of the surface resistivity and volume resistance of the layer 150, and w is the overall length of the electrode, which is nominally the width of the drum 10.

The voltage source 140 is connected to the electrodes 14, as described hereinabove, wherein a conductive brush or roller directly contacts an exposed portion of the electrodes on the edge of the drum or conducts through the upper conductive layers.

Figure 12:
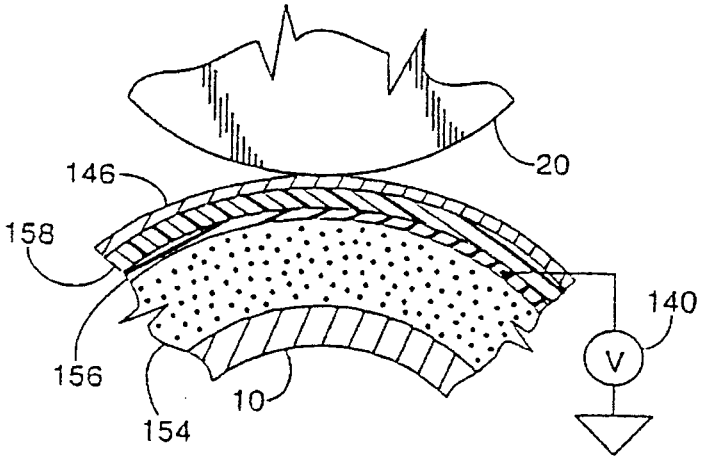
FIG. 12, illustrates another embodiment of the present invention wherein the core of the drum is covered by an insulating layer with a conducting layer disposed on the upper surface thereof.

Referring now to FIG. 12 there is illustrated another embodiment of the present invention wherein the core of the drum 10 is covered by an insulating layer 154 of a thickness 3 mm and of a material utilizing Neoprene, with a conducting layer 156 disposed on the upper surface thereof. The conductive layer 156 is connected to the voltage source 140. This layer provides the advantage of separating the electrical characteristics of the material from the mechanical characteristics. This is covered by an insulative layer 158, similar to the gripping layer 144, with the paper 146 disposed on the upper surface thereof.

Figure 13:
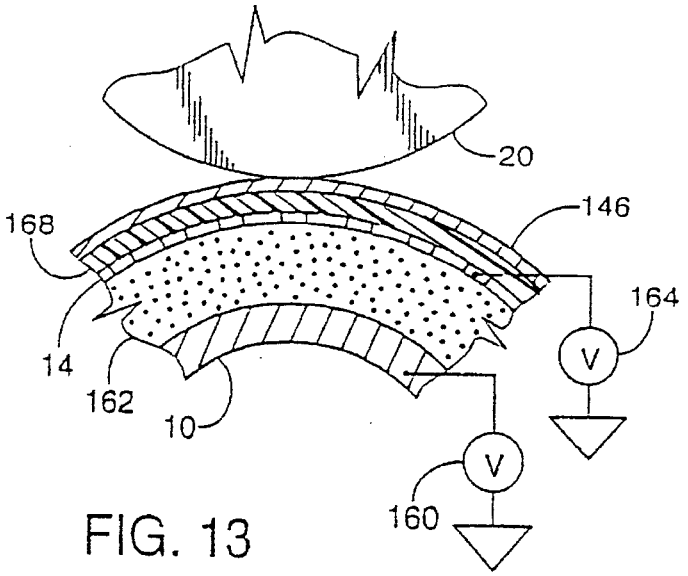
FIG. 13 illustrates another embodiment of the transfer drum.

Referring now to FIG. 13, there is illustrated another embodiment of the transfer drum. A voltage source 160 is connected to the core 10 and the core 10 then has a conductive resilient layer 162 disposed on the surface thereof. The electrodes 14 are disposed in a layer on the upper surface of the layer 162 with the voltage source 164 connected thereto through a conductive brush or such. The voltage supplies 160 and 164 are used to establish the uniform voltage on the underside of the resilient conductive layer 162 and a voltage profile on the top side. The benefit of this configuration is to provide a variable surface potential while maintaining a uniform gripping voltage source. A gripping layer 168 is disposed on the upper surface of the electrodes 14, similar to the gripping layer 158, which is then covered by the paper 146. Additionally, it is noted that by applying the voltage 164 that is different than the voltage of supply 160 (perhaps even 0), a voltage profile with a voltage minimum will be obtained at the entrance to the nip. This will reduce the pre-nip discharge for multiple transfer operation. This voltage minimum characteristic is also shown in FIG. 6*a*.

Figure 14:
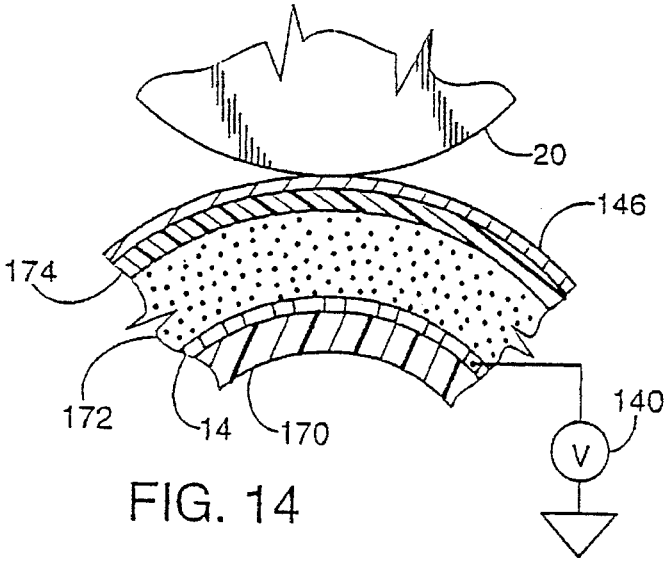
FIG. 14 illustrates another embodiment of the transfer drum construction.

Referring now to FIG. 14, there is illustrated another embodiment of the transfer drum construction. In this configuration, an insulating core 170 is provided, similar to the dimension of the core 10 but fabricated from insulating material such as polycarbonate. The electrode layer with electrodes 14 is then disposed on the surface of the insulating core 170 and the voltage source 140 connected thereto. A conducting resilient layer 172 is disposed on the surface of the electrodes 14 to a thickness of 3 mm and fabricated from butylacrylonitrile. A gripping layer 174, similar to the gripping layer 144 is disposed on top of the resilient layer 172, with the paper 146 disposed on the upper surface thereof.

Figure 15:
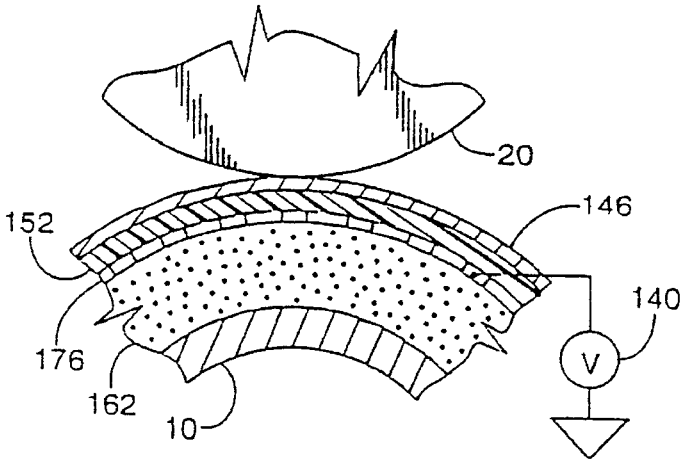
FIG. 15 illustrates another embodiment of the transfer drum construction.

Referring now to FIG. 15, there is illustrated another embodiment of the transfer drum construction. The conducting layer 156 in FIG. 11 is removed such that a layer of interdigitated electrodes 176 can be utilized between the gripping layer 152 and the resilient layer 148. This resilient layer, as described above, is an insulating layer. The voltage source 140 is connected to the electrodes 176. The interdigitated electrodes increase the value of w in Equation 1, thus allowing a much higher value of r in Equation 1. The interdigitated electrodes are illustrated below in FIG. 17.

Figure 16:
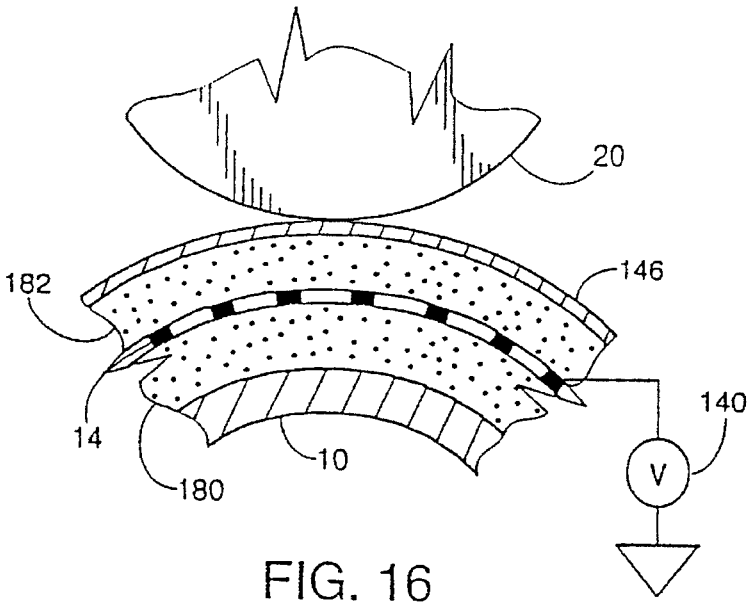
FIG. 16 illustrates another embodiment of the transfer drum.

Referring now to FIG. 16, there is illustrated another embodiment of the present invention. The core 10 has disposed thereon a first resilient layer 180, covered by the electrode layer having electrodes 14 disposed therein. The electrodes 14 are connected to a voltage source 140 through conductive brushes or the such. A second resilient layer 182 is disposed over the electrodes 14 with the paper 146 disposed on the surface thereof. The layer 180 can be a resilient layer that is resistive or insulative. The resilient layer 182 is resistive with a resistivity of less than $10^{10}$ Ohms/cm. The advantage provided by this configuration is that the physical effects (i.e., nip pressure variations) of the electrode layer are reduced by enclosing the electrodes 14 in two resilient layers 180 and 182.

Figure 17:
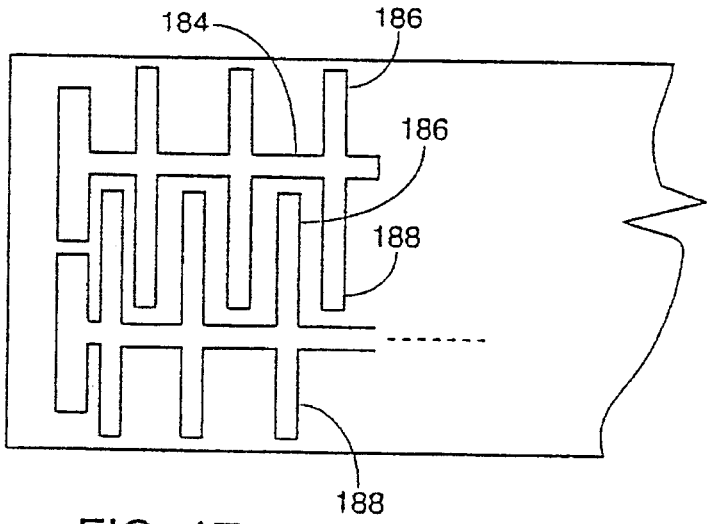
FIG. 17 illustrates an embodiment illustrating the interdigitated electrodes described above with respect to FIG. 15.

Referring now to FIG. 17, there is illustrated an embodiment illustrating the interdigitated electrodes described above with respect to FIG. 15. The interdigitated electrodes each have a plurality of longitudinal arms 184 with extended or interdigitated electrodes 186 and 188 extending from either side thereof. Adjacent electrodes will have the interdigitated arms or electrodes 186 and 188 offset along the longitudinal arm 184 such that they will interdigitate with each other, thereby effectively increasing apparent "w" of Equation 1, such that the controlled resistivity layer can be at a higher resistivity to the point that it can be eliminated.

Figure 18:
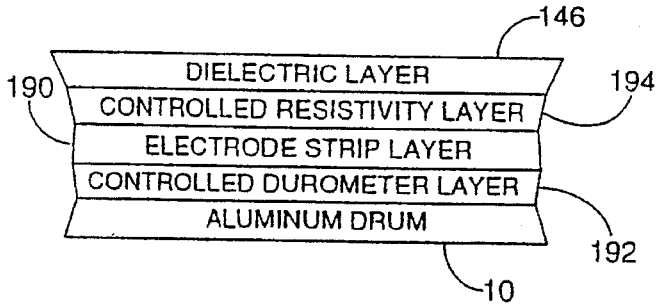
FIG. 18 illustrates a detail of the physical layers in a section of the BED drum with the paper attached thereto.

Referring now to FIG. 18, there is illustrated a detail of the physical layers in a section of the BED drum 48 with the paper 146 attached thereto. An electrode strip 190 is disposed between a controlled durometer layer 192 and a controlled resistivity layer 194. The controlled durometer layer 192 represents the resilient layer 142 in FIG. 10 and subsequent figures. The controlled resistivity layer 194 represents the gripping layer 144 in FIG. 10. The controlled durometer layer 192 is disposed between the electrode strip layer 190 and the aluminum drum 10, the electrode strip layer 190 either comprising a plurality of electrodes in strips, as described above, or a single continuous layer.

Figure 19:
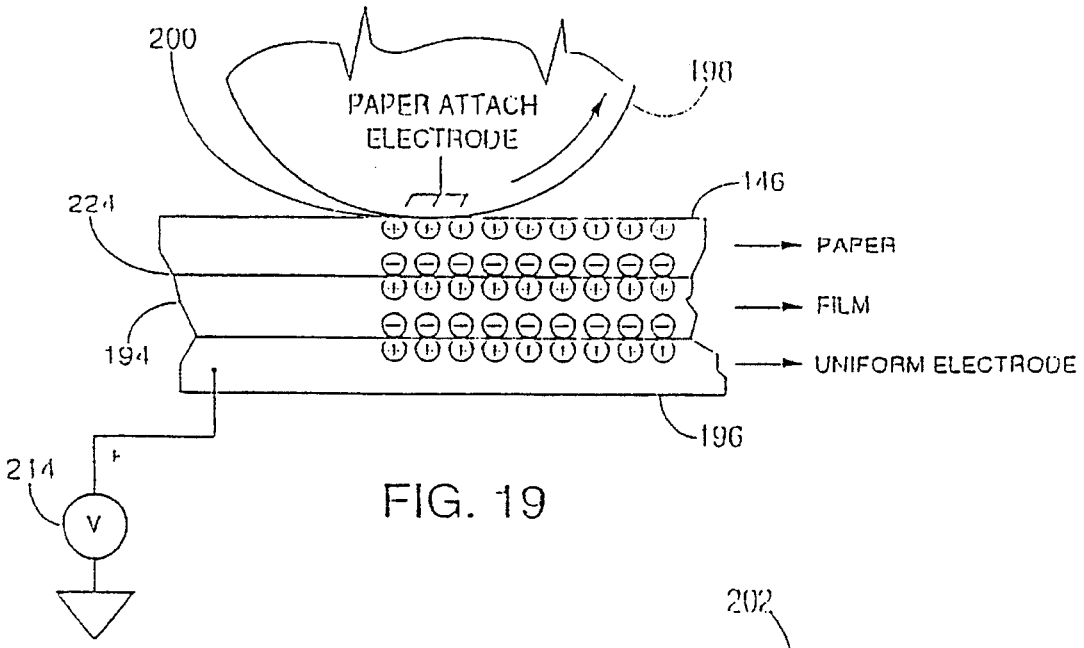
FIG. 19 illustrates a diagrammatic view of the paper layer, the film layer and the uniform electrode layer.

Referring now to FIG. 19, there is illustrated a diagrammatic view of the paper layer 146, the film layer 194 and the uniform electrode 196 layer, which comprises the electrode strip layer 190. A paper attach electrode 198 is provided, which is operable to contact the paper and dispose a potential thereon which, in the preferred embodiment, is ground. At the point the electrode 198 contacts the paper 146, a nip 200 is formed.

Figure 20:
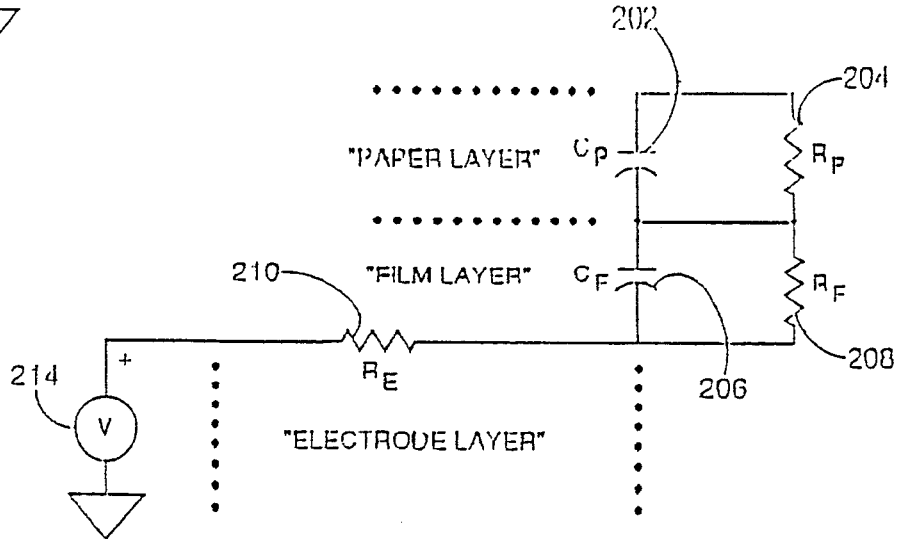
FIG. 20 illustrates a schematic representation of the paper and film layers.

Referring now to FIG. 20, there is illustrated a schematic representation of the layers 146, 174 and 196. A first capacitor 202, labelled $C_P$, represents a paper layer 146, with a parallel resistor 204 labelled $R_P$. The film layer 194 is represented by a capacitor 206 labelled $C_F$, with a resistor 208 disposed in parallel therewith, labelled $R_F$. The electrode layer 196 is represented by a resistance 210 labelled $R_E$, which goes to a transfer/attach power supply.

Figure 21:
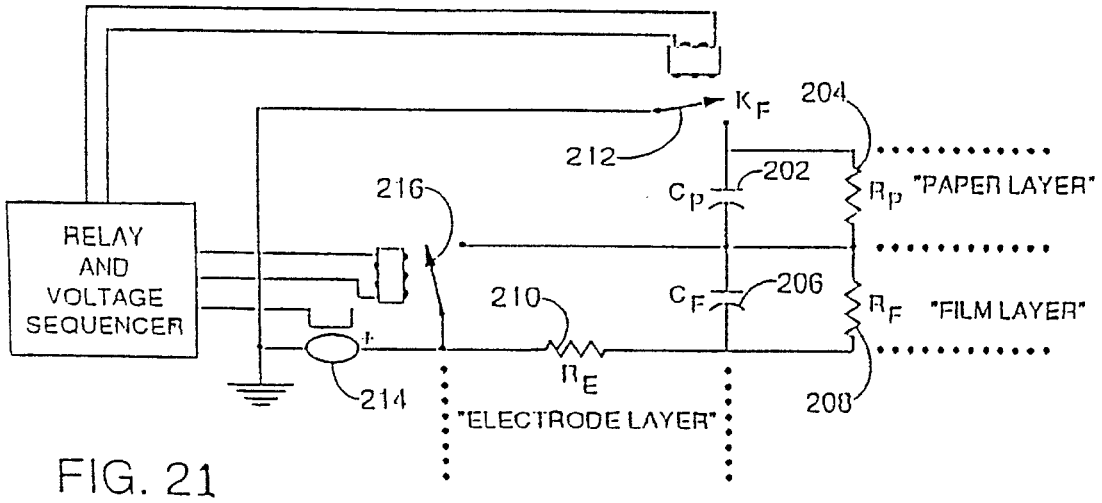
FIG. 21 illustrates a schematic diagram of the overall operation of the transfer drum.

Referring now to FIG. 21, there is illustrated a schematic diagram of a simulator circuit capable of simulating the overall operation of the transfer drum 48. The schematic representation shows a switch or relay 212 that is labelled $K_P$ which is the charge relay, which is operable to connect the upper surface of a paper layer 146, represented by the capacitor 206 and resistor 204, to ground when the switch 212 is closed. An attach/transfer voltage source 214 is provided, having the positive voltage terminal thereof connected to the most distal side of resistor 210 and essentially to the uniform electrode layer 196. The other side of the supply 214 is connected to ground. A switch or relay 216 is provided which is labelled $K_F$, which is operable to connect the positive side of the supply 214 to the top of the film layer 194. This is a discharge operation that will be described in more detail hereinbelow.

When paper is first presented to the drum in the nip 200 for attachment, the charge distribution of FIG. 19 is illustrated wherein positive charges are attracted to the upper surface of the paper and negative charges attracted to the lower surface thereof. Similarly, the positive charges are attracted to the upper surface of the film layer 194 and negative charges attracted to the lower surface thereof, with positive charges attracted to the surface of the uniform electrode 196. This results in mirror images of equal and opposite charges formed at each interface boundary between the various layers 146, 194 and 196. With the dielectric layers, layers 146 and 194, most of these charges are just below the surfaces of the respective layers and cannot cross the interface boundary between the film. However, the charges are strongly attracted to each other and provide the attractive force which holds the paper on the drum. This attractive force is normal to the surface of the drum and directly bonds the paper layer 146 to the drum in that direction. Additionally, this normal force is operable for generating the frictional forces that secure the paper to the drum in the remaining two axis, preventing paper slip. The source charge for the paper attachment is the attach/transfer supply 214. The switch 212 represents the paper attach electrode 198.

When a selection of paper enters the nip 200, the composite capacitor formed by the paper and film layers is charged in a manner similar to the charging of $C_P$ and $C_F$ as illustrated in FIG. 21 when the relay $K_P$ is closed. If the dwell time of a section of paper in the attach nip 200 is sufficiently long relative to the time constant of the resistor 210 ($R_E$) and the series connected pair capacitor $C_P$ and $C_F$, this composite capacitor will charge to a voltage very nearly equal to that of the attach/transfer supply 214. Fully charging the paper film composite capacitor results in the maximum transfer of charge and therefore the generation of the maximum attractive or bonding force of the paper to the drum assembly.

After the paper leaves the attach nip 200, the capacitance that is associated with the paper and film layers begins to discharge. The paper layer then discharges at a rate determined by its dielectric content and volume resistivity, with near complete discharge, i.e., to only a small voltage across the paper, occurring in less than 300 milliseconds. This discharge is similar to the discharge behavior of $C_P$ and $R_P$ in FIG. 21. The film layer also discharges at a rate determined by its dielectric constant and the volume resistivity (and other factors), but the time required is much longer than that of the paper. The film layer 194 may require more than 200 seconds for near complete discharge, and does so in a manner that is similar to the discharge characteristics of $C_F$ and $R_F$ in FIG. 4.

The larger discharge time of the film layer 194 accounts for the ability of the transfer drum to grip paper much longer than the discharge time of the paper would indicate. Even though the voltage across the paper collapses relatively quickly, the trapped charges that were induced at the paper's surface are trapped at the paper surface by the residual voltage on the film layer. The trapped charges eventually migrate back into the bulk of the paper, but only after the film layer 194 has discharged significantly.

Because of the large discharge time of the film layer 194, some mechanism to discharge the film completely between successive paper attach intervals is required. This function is simulated by the relay $K_F$ in FIG. 21. The actual discharge mechanism is very similar to the attach electrode 198 in FIG. 19, but the discharge electrode is held at the same potential as the electrode layer 196 to facilitate discharge. The discharge electrode is physically located upstream of the paper attach area and is in contact with the drum 48 only during the paper attach operation.

With further reference to FIG. 21, the operation of the layered structure of FIG. 18 will be described in more detail as to its effect on the paper gripping operation. By way of the example, in the case where a very resistant paper or transparency material is utilized, the resistance of resistor 210 ($R_E$) is much less than the resistance of the paper $R_P$, and the resistance of resistor 210 ($R_E$) is much less than resistor $R_F$. The composite capacitor will charge to the applied voltage with the time constant $R_E C_{EQ}$, where:

$$\frac{C_P C_F}{(C_P + C_F)} \tag{2}$$

If the time constant $R_E$, $C_{EQ}$ is much less than the time constant $T_N$, where $T_N$ is equal to the time that a section of paper is present in the attachment 200, then the voltage across the capacitor will very nearly reach the magnitude of the attach/transfer voltage of voltage supply 214 ($V_A$). The voltages across each of the components of the composite capacitor, $C_P$ and $C_F$, are given by:

$$V_{CF}=V_A(C_F/(C_P+C_F)) \tag{3}$$

$$V_{CF}=V_A(C_F/(C_P+C_F)) \tag{4}$$

For the actual paper and film layer of the drum, the analogous equations are:

$$V_P=V_A(\epsilon_F/((t_F/t_P)\epsilon_P+\epsilon_F)=V_{CP} \tag{5}$$

$$V_F=V_A(\epsilon_F/((t_P/t_F)\epsilon_F+\epsilon_F)=V_{CF} \tag{6}$$

where:

$\epsilon_P$=dielectric constant of the paper $\epsilon_F$=dielectric constant of the film $t_P$=thickness of the paper $t_P$=thickness of the film The magnitude of the gripping force is directly proportional to the amount of charge trapped at the paper/film interface and, to maximize it, the composite capacitance, $C_{EQ}$, must be as large as possible. From Equation 2, it can be seen that, for a given paper, the largest value that the composite capacitance can have is $C_P$. This occurs when $C_F$ is much greater than $C_P$. Therefore, Equation 2 can be rewritten as:

$$C_{EQ}=A\epsilon_P\epsilon_F/(t_F\epsilon_P+t_F\epsilon_P) \tag{7}$$

where A=area of the paper section in the nip. From this, it can be seen that, for a given paper with a dielectric constant of $\epsilon_P$ and thickness $t_p$, $C_{EQ}$ approaches a value of $C_P$ if the dielectric constant of the film is much greater than the dielectric constant of the paper, or the thickness of the film is much smaller than the thickness of the paper. Under these conditions, Equations 5 and 6 indicate that, during attach, most of the voltage will be developed across the paper, a desirable condition for good gripping.

In the case where the resistance $R_E$ is substantially equal to the resistance of the paper $R_P$, i.e., for very low resistance paper, the equations will differ somewhat. When the section of paper 146 enters the nip 200, both $C_P$ and $C_F$ will act as short circuits. However, if $C_P$ is much less than $C_F$, $C_P$ begins charging to:

$$V_P=V_A(R_P/(R_P+R_E)) \tag{8}$$

with a time constant of:

$$(R_E R_P/(R_E+R_P))C_P \tag{9}$$

Then, if the time constant $R_E C_F$ is much less than $T_N$, and $R_P C_F$ is much less than $T_N$, $C_P$ will charge to $V_A$ with a time constant $(R_E+R_P)$ $C_F$ while $C_P$ completely discharges through $R_P$. Equation 8 indicates that, to maximize the voltage across the paper, $R_E$ should be selected such that $R_E$ is much less than $R_P$. Additionally, it is equally important that $C_F$ be selected such that $C_P$ is much less than $C_F$.

For the case where the resistance of the paper is much less than the resistance of the electrode layer 196 and much less than the resistance of the film, Equation 8 shows that very little voltage will be developed across the paper. Thus, only a very small gripping force will be generated.

After the paper 146 is gripped onto the upper surface of the film layer 194, toner must then be transferred from the photoconductor to the paper. Since toner transfer efficiency is a function of applied voltage in the transfer nip, it is desirable that the dielectric composed of the paper and film layers have no memory of the attach operation (i.e., these layers would be fully discharged) as a section of the paper 146 enters the transfer nip, thus allowing complete and independent control of the transfer nip voltage. However, if the paper and film were fully discharged, they would not be electrostatically attached to the drum, an undesirable situation.

Figure 22:
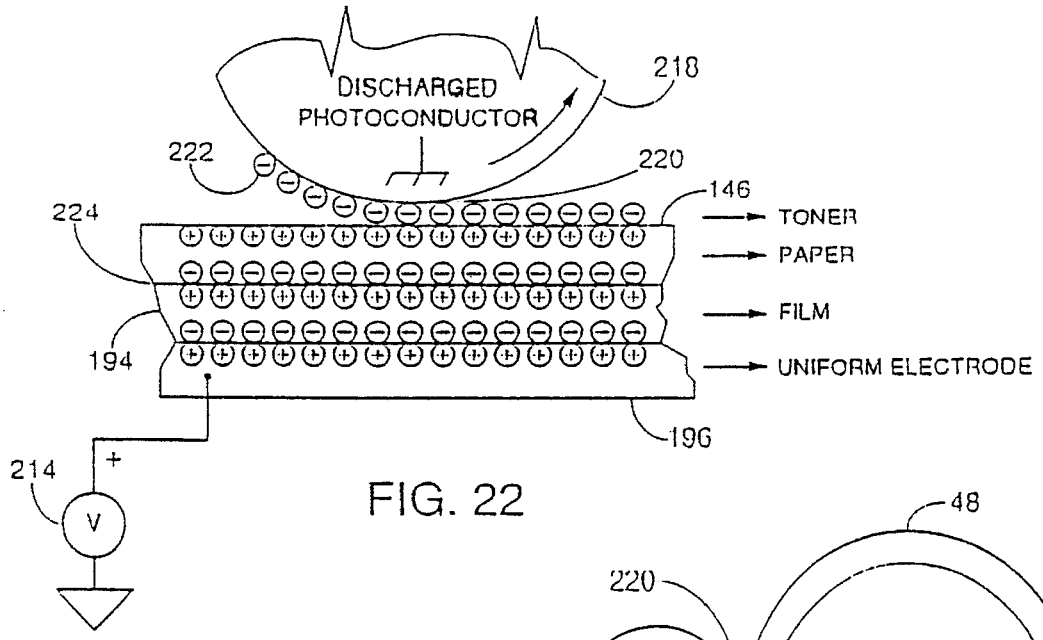
FIG. 22 illustrates a cross sectional diagram of the structure of FIG. 19, when it passes under a photoconductor drum, which is in a discharge mode.

Referring now to FIG. 22, there is illustrated a cross sectional diagram of the structure of FIG. 19, when it passes under a photoconductor drum 218 which is in a discharge mode, i.e., there is ground potential applied thereto. Toner particles 222 are disposed on the photoconductor drum 218 and have a negative charge placed thereon. This is a conventional transfer operation. When the paper 146 passes under the photoconductor drum 218, a transfer nip 220 is formed. Since the electrode layer 196 is a uniform electrode, the voltage of the layer 196 is that of the attach/transfer voltage source 214. This will result in a strong force of attraction at the film and paper interface, represented by a reference numeral 224.

Figure 23:
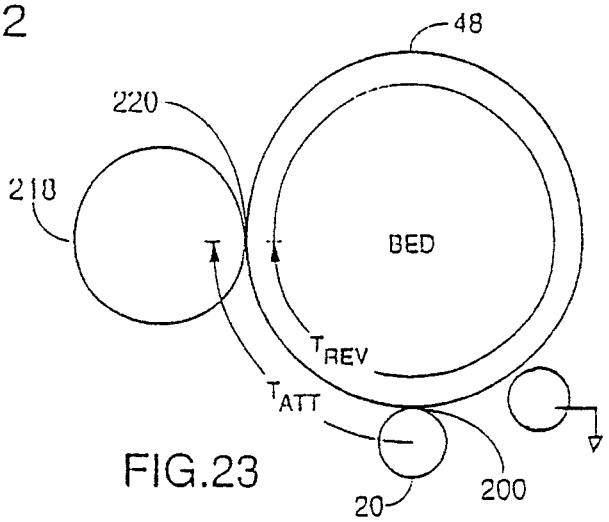
FIG. 23 illustrates another view of the spatial difference between the photoconductor drum and the paper attach electrode disposed about the buried electrode drum.

Referring now to FIG. 23, there is illustrated another view of the spatial difference between the photoconductor drum 218 and the paper attach electrode 20 disposed about the buried electrode drum 48. It can be seen that the distance between the paper attach electrode 20 and the photoconductor 218 requires a time $T_{ATT}$ for the paper to move from the paper attach nip 200 to the transfer nip 220. Additionally, the time for the paper to traverse the entire circumference of the drum 48 is the time $T_{REV}$. Additionally, a discharge roller 201 is provided which is connected to ground for completely discharging the surface.

Figure 24:
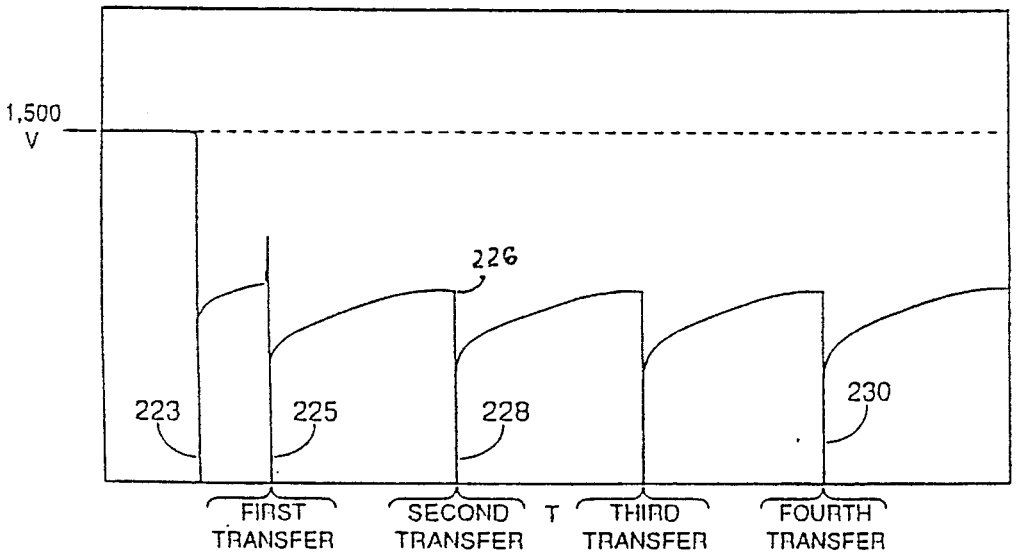
FIG. 24 illustrates a plot of simulated voltage vs. time for an arbitrary section of paper as it travels around the drum 48 four times in a four pass (i.e., color) print.

Referring now to FIG. 24, there is illustrated a simulated voltage versus time plot for an arbitrary section of paper as it travels around the drum 48 four times in a four pass (i.e., color) print. The first transition to zero potential is caused by the paper attach electrode 20 contacting the drum and the paper passing into the paper attach nip 200, this represented by the relay 212 ($K_P$) in FIG. 21 closing. This is represented by a point 223. The paper will then move to the toner transfer nip 220, where the voltage will again go to a zero potential, as represented by a point 225, the time difference between points 223 and 225 being $T_{ATT}$. This will be a toner transfer point. Then the paper traverses around the drum and the voltage will increase to a higher voltage level (relative to ground potential) at a point 226 after time $T_{REV}$, at which time the paper will again arrive at the toner transfer nip 220 and the potential will again go to zero as represented by a point 228. Of course, the paper attach electrode 20 has been removed after the last portion of the paper was attached to the drum 48, in the first pass, this being a single pass. This will continue for three more passes up to a point 230. Each of the transitions at the transfer nip 220 are also represented by closure of the relay 214 in the simulation of FIG. 21. Because the surface of the photoconductor drum 218 is either discharged or at a low potential (relative to the applied transfer voltage of source 214), the photoconductor drum 218 performs much like the attach electrode 20 in an electrical sense. Although not discussed or shown in detail, the voltage of source 214 is stepped up slightly for each successive toner transfer to account for the thickness of the previous toner layer, this being a conventional operation.

Figure 25:
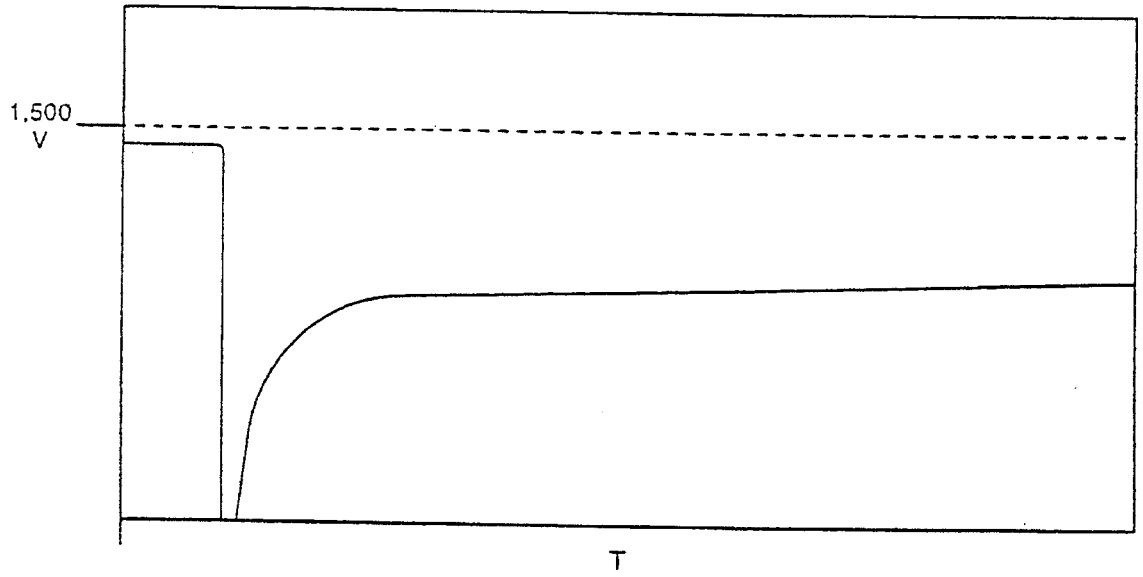
FIG. 25 illustrates a simulated voltage vs. time plot of a single pass.

The surface of the paper is held at a zero potential for the entire time that it is in either the paper attach nip 200 or the transfer nip 220. During this time, the paper and film composite capacitor ($C_{EQ}$) becomes very nearly charged to the full potential of the attach/transfer source 214. Upon leaving either of these nips, the capacitance $C_{EQ}$ begins to discharge. The first portion of the discharge occurs between points 223 and 225 and is quite rapid, approximately 170 milliseconds, this due primarily to the paper discharging. This is equivalent to the capacitance $C_P$ discharging through the resistance $R_P$ and is illustrated in more detail in FIG. 25. In the second portion of the curve between points 225 and 228, and subsequent passes to point 230, it can be seen that the discharge is quite slow, wherein only a partial discharge is apparent. This is equivalent to the capacitance $C_F$ discharging through the resistance $R_F$. In the preferred embodiment, the voltage on the electrode layer 196 is held at a constant voltage of 1500 volts for the curves of FIG. 24 and FIG. 25.

The voltage available for transfer of toner is the difference between the voltage at the surface of the paper and ground potential, just before the paper enters the transfer nip 220. Thus, for a constant voltage on drum 48, the amount that the film layer discharges between each successive toner transfer pass (i.e., each revolution of the drum 48) determines the amount of voltage available for toner transfer.

The amount of time available for the paper/film discharge after the paper is attached is the time $T_{ATT}$ for the first layer of toner. The amount of time available for the paper/film discharge is the time $T_{REV}$, as illustrated in FIG. 23. This time is required for the subsequent layers of toner and, therefore, the voltage across the film layer 194 must not discharge to a level too low to maintain attraction, but it must discharge sufficiently to allow a voltage difference at the transfer nip 220. The film layer 194 should have a discharge time constant approximately equal to $T_{ATT}$ to minimize the effect of the residual voltage on the film layer during transfer of the first layer of toner, and yet reserve sufficient potential across the film to maintain gripping of the paper (if $R_FC_F$ is much less than $T_{ATT}$, gripping cannot be maintained). However, for the configuration illustrated in FIG. 23, $T_{ATT}=T_{REV}/4$ and gripping must be maintained for at least as long as $T_{REV}$.

This relationship suggests that the film layer should have a voltage dependant discharge time constant; that is, the RC time constant (or relaxation time constant) of the film should be small for high potentials and large for low potentials. A voltage dependent characteristic of this type would allow large potentials to be used for paper attach and toner transfer and allow a small but sufficient residual potential in the film layer for paper gripping maintenance. Because the residual would be small, effects of previous paper attach and toner transfer operations on those subsequent thereto would be minimized.

It is well known that the discharge time constant or RC time constant for a capacitor or film layer is characterized by the equation:

$$V=V_o * e-(t/RC) \quad (10)$$

where:

V is the voltage across a film, $V_o$ is the initial voltage, t is time,

C is the capacitance of the film, and

R is the resistance of the film.

The characteristic discharge time is that time that equals the product of RC, and so the exponential term is unity. Specifically the discharge time is given by the equation:

$$t=RC \quad (11)$$

It is of particular importance that in the case of a preferred gripping layer the characteristics of the film do not behave according to the above equation. Specifically, the behavior of the film discharge time constant is a function of voltage as well as R and C, or more specifically R and/or C are a function of voltage and not constant for the film material.

And more specifically, for the improved performance of the gripping layer, the discharge time for the film decreases with increasing voltage:

$$V=V_o * e-(t/f(R,C,V)) \quad (12)$$

Figure 25A:
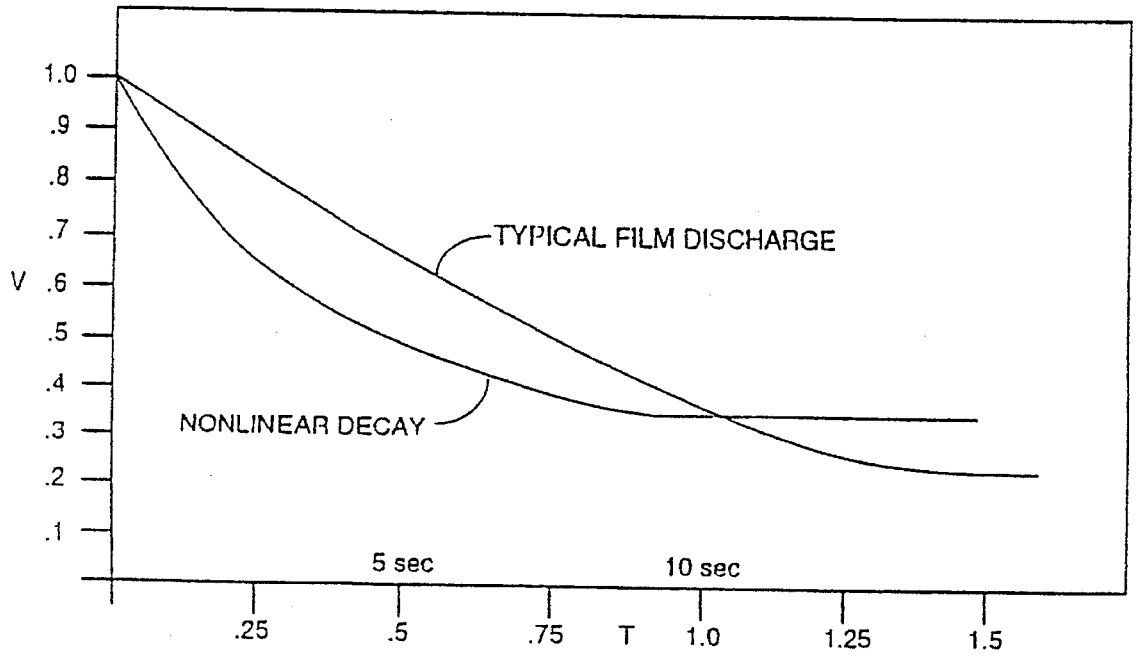
FIG. 25*a* illustrates a graph of decay voltages.

In this case, the exponent is a function that is dependent on V. This "nonlinear" behavior is important for the gripping layer to decay sufficient for transfer voltage and yet retain sufficient voltage for gripping. This is shown graphically in the graph of FIG. 25*a*. Note that the preferred nonlinear characteristic in the nonlinear decay curve is reflected in quicker initial discharge characteristics for good transfer and then a slowing to a higher value for improved gripping.

Tables 1 and 2 illustrate discharge characteristics for two films whose dielectric contents are very nearly equal. The film associated with Table 1 is an extruded tube of Elf Atochem Kynar Flex 2800, a proprietary copolymer formed using polyvinylidene fluoride (PVDF) and hexafluoropropylene (HFP). The average wall thickness was approximately 4 mils. The manufacturer's specification for the dielectric for the film is (9.4–10.6)$\in_o$. The volume resistivity is specified as $2.2\times10^{14}$ Ohm-centimeters. The film associated with Table 2 was obtained from DuPont as cast 8.5"× 11" sheets of Tedlar (TST20SG4), a polyvinyl fluoride (PVF) polymer. The average thickness was approximately 2 mils. The manufacture's specifications for the dielectric constant of the film is (8–9) $\in_o$. The volume resistivity is specified as $1.8\times10^{14}$ Ohm-centimeters.

TABLE 1

| | | SECONDS FOR DISCHARGE TO | | | |
|---|---|---|---|---|---|
| | | 3/4 V | V/2 | 0.37 V | V/4 |
| INITIAL VOLTAGE V | 1600 | 1.4 | 4.9 | 10.3 | 22.1 |
| | 1400 | 1.7 | 5.1 | 12.8 | 27.3 |
| | 1200 | 2.2 | 8.1 | 16.6 | 37.6 |
| | 1000 | 2.9 | 9.6 | 19.8 | 41.0 |
| | 800 | 5.3 | 16.8 | 32.1 | 54.9 |
| | 600 | 8.2 | 26.4 | 45.9 | 78.9 |
| | 400 | 12.4 | 39.4 | 64.5 | 105.8 |
| | 200 | 13.3 | 43.9 | 74.9 | 123.8 |

TABLE 2

| | | SECONDS FOR DISCHARGE TO | | | |
|---|---|---|---|---|---|
| | | 3/4 V | V/2 | 0.37 V | V/4 |
| INITIAL VOLTAGE V | 1600 | 4.1 | 13.4 | 22.8 | 39.4 |
| | 1400 | 6.0 | 19.1 | 29.7 | 49.4 |
| | 1200 | 7.2 | 21.3 | 36.1 | 59.6 |
| | 1000 | 8.8 | 27.7 | 45.7 | 74.7 |
| | 800 | 10.9 | 33.1 | 54.7 | 87.5 |
| | 600 | 13.5 | 40.3 | 65.0 | 103.8 |
| | 400 | 16.7 | 48.6 | 78.3 | 123.8 |
| | 200 | 20.3 | 59.8 | 95.6 | 147.8 |

Figure 26:
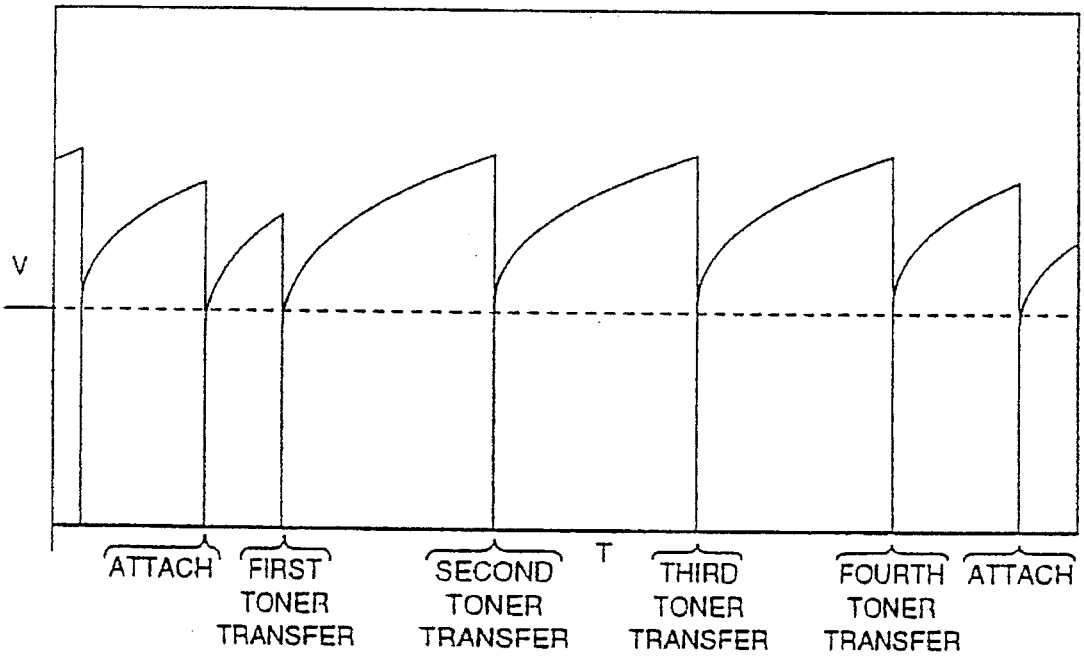
FIG. 26 illustrates a simulated voltage vs. time plot of a four pass operation.
Figure 27:
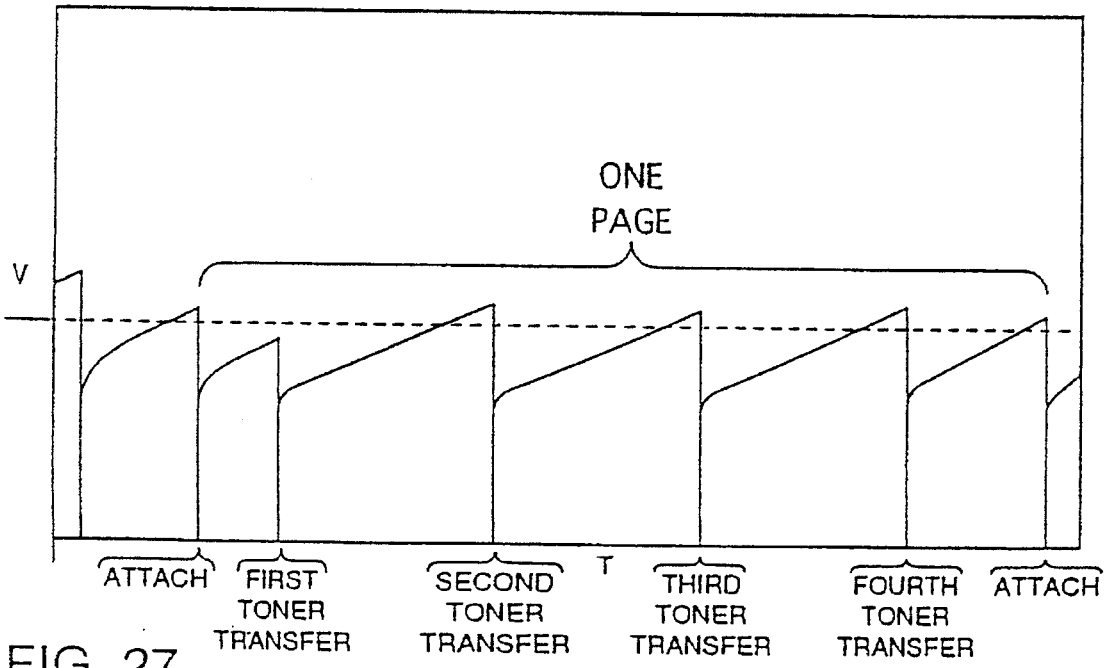
FIG. 27 illustrates a simulated voltage vs. time plot of a four pass operation.
Figure 27A:
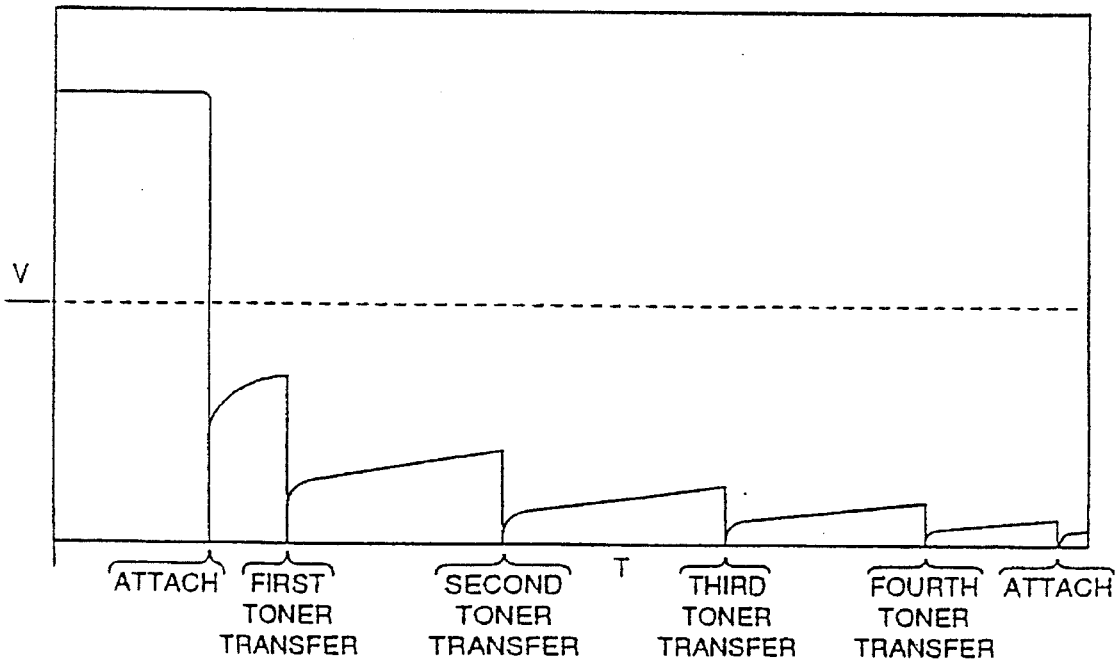
FIG. 27*a* illustrates an alternate simulated voltage vs. time plot of a four pass operation utilizing Mylar.

The discharge time constant ($R_FC_F$) measured for low starting voltages are very nearly equal and are in agreement with the manufacturers stated values for dielectric constant and volume resistivity. Each of the two films exhibit the voltage dependent discharge time constant. By comparing the discharge times in the ¾ V column, it can be seen that the film associated with Table 1 discharges faster at high voltages than does the film of Table 2. The response for Table 1 is illustrated in FIG. 26 and the response for the film of Table 2 is illustrated in FIG. 27. FIG. 27*a* illustrates a response for a film such as Mylar, which response illustrates that insufficient voltage is available for subsequent (multiple) passes. Film voltage is held at a constant 2200 volts for each type. The discharge characteristics of FIG. 26 are preferred. In the film of FIG. 27*a*, the film was manufactured by Apollo as a transparency material. Its chemical and electrical properties are unknown, but the dielectric constant approximates that of Mylar®, approximately 3 $\in_o$. The thickness is approximately 6 mils.

Figure 28:
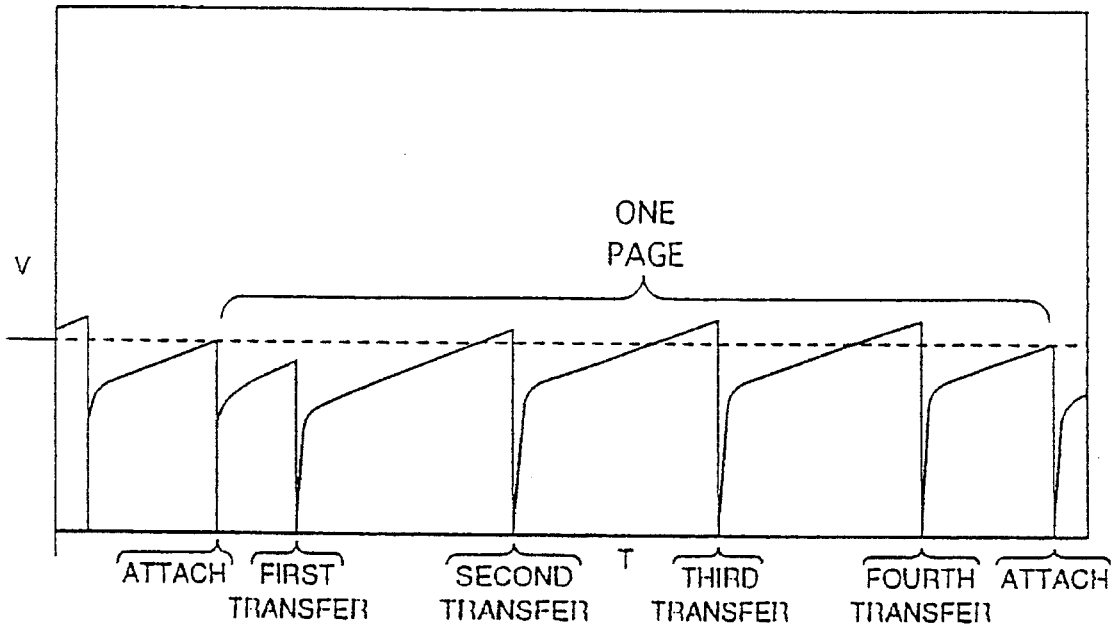
FIG. 28 illustrates a simulated voltage versus time plot for an arbitrary section of paper as it travels around the drum four times during a four pass color print with no discharge before attack.
Figure 29:
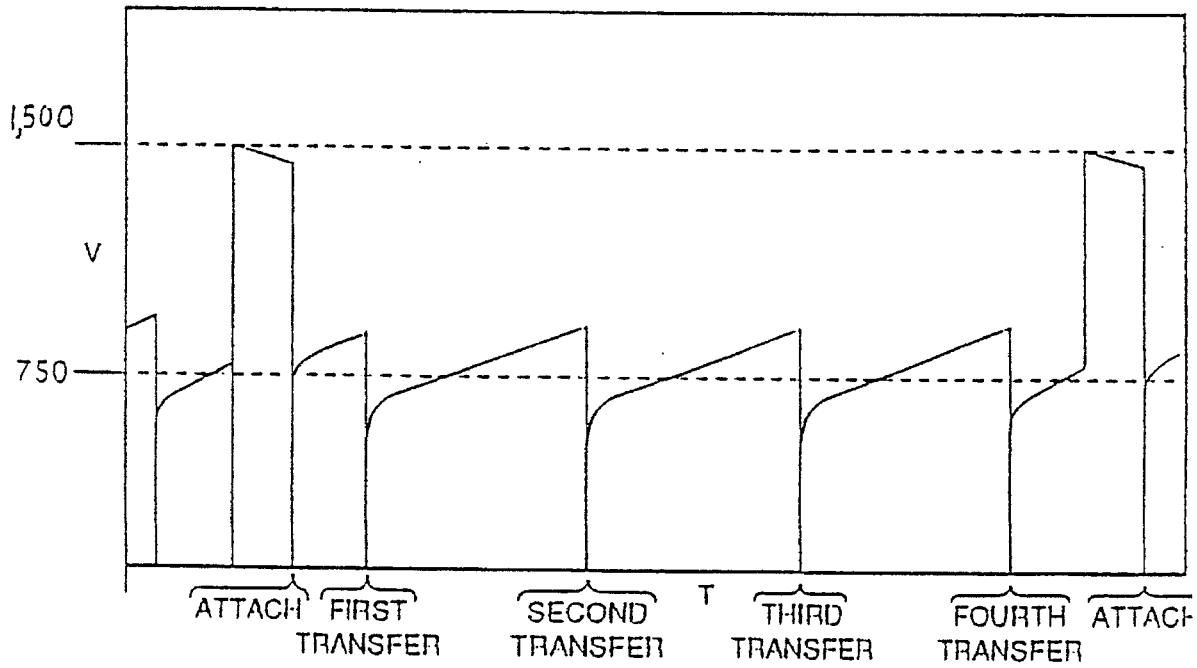
FIG. 29 illustrates the operation of FIG. 29 with discharge.

Referring now to FIG. 28, there is illustrated a simulated voltage versus time plot for a sheet of paper as it travels around the drum four times during a four pass color print. The attach and transfer voltage transition shown in the center of the figure are for a single page of a multi-page print job. The voltage available for paper attach or toner transfer is the difference between the voltage at the surface of the paper and ground potential. In FIG. 28, it can be noted that the voltage available for paper attach is dependent on the voltage left on the film layer by the previous (and fourth toner layer) transfer. As a result, subsequent pages of a multi-page print job will not be gripped as firmly as the first page. This situation is remedied as illustrated in FIG. 29 by applying a discharge voltage with the relay 216 labelled $K_F$ to the upper surface of the film layer 194. The voltage is approximately 1500 volts in the attach operation in the nip 200 whereas the attach voltage in FIG. 28 is less than 750 volts.

Figure 30:
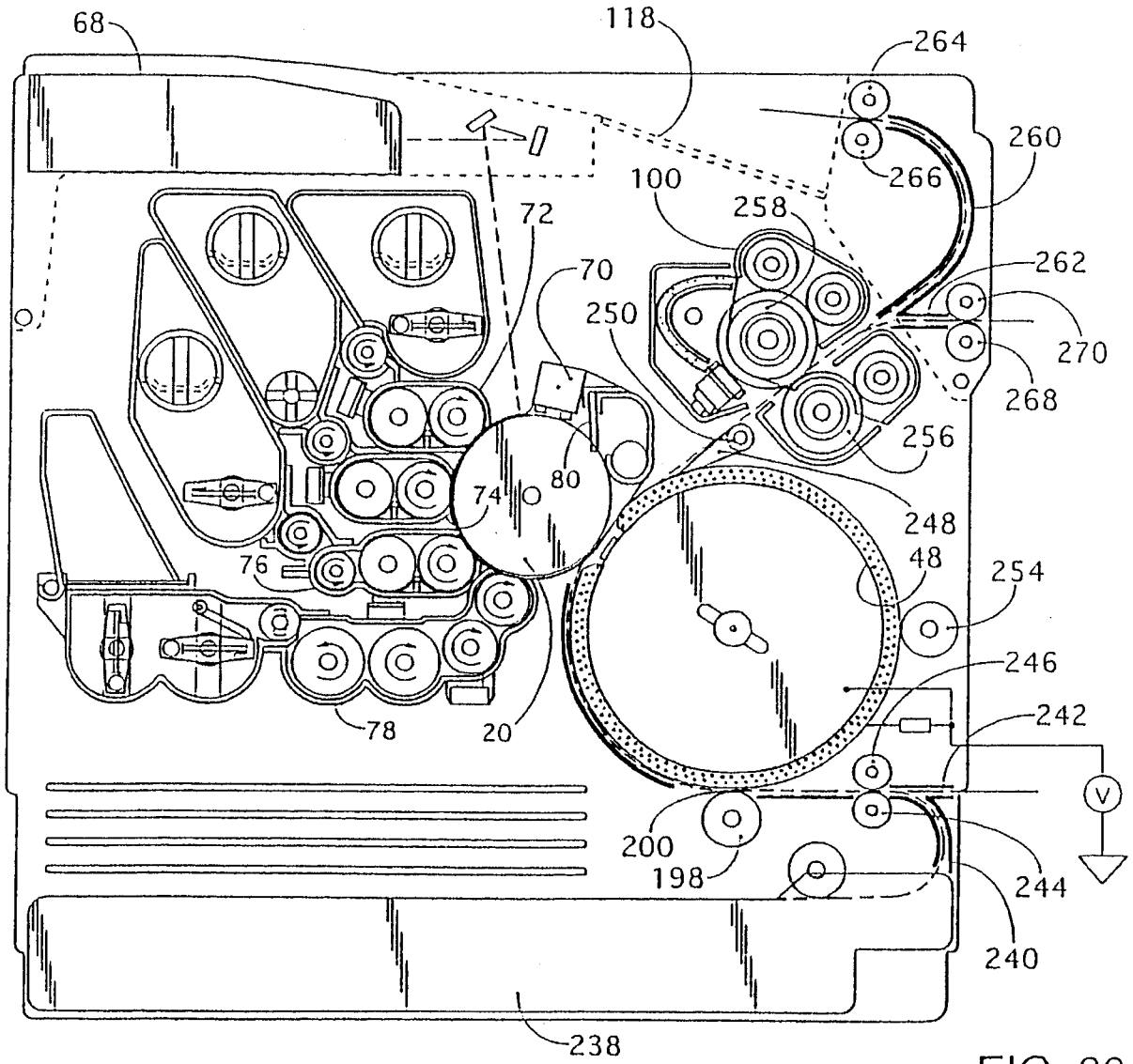
FIG. 30 illustrates a side-view of the overall electrophotographic printer mechanism.

Referring now to FIG. 30, there is illustrated a side-view of the overall electrophotographic printer mechanism depicting an embodiment of the present invention utilizing a buried electrode drum 48 which utilizes a single electrode or multiple electrodes and the gripping layer described hereinabove with respect to FIGS. 10, et seq. The paper is fed from a paper tray 238 into an inlet paper path 240. Further, it can be routed from a manual exterior paper path 242. The paper is then routed between two rollers, a lower roller 244 and an upper roller 246, which provide a "precurl" operation, which will be described in more detail hereinbelow. The paper is then fed into the nip 200 between the attached electrode roller 198 and the drum 48, as described above.

After the multiple images have been disposed on the paper for a color print, or a single image has been disposed on the paper for a black and white print, a stripper arm 248 is provided that is operable to rotate down about a pivot point 250 onto the surface of the drum 48 to extract or "strip" the paper from the surface of the drum 48, since the paper is electrostatically held to the drum 48. For multiple prints, the stripper arm 248 is rotated up away from the drum and the attach electrode roller 198 is also pulled away from the drum during the multiple passes.

A cleaning roller 254 is provided which can be lowered onto the surface of the drum 48 for a cleaning operation after the paper has been stripped therefrom and prior to a new sheet being disposed thereon. Although not illustrated, a brush or roller similar to the roller 40 of FIG. 6A is utilized to supply voltage to the electrode layer.

The rollers 244 and 246, as will be described in more detail hereinbelow, are utilized to place a "precurl" on the paper such that it curves upwards about the drum 48. This significantly lowers the voltage required in order to attach the paper with the attach electrode roller 198. If this is not utilized, a significantly higher voltage is required to properly grip paper or the paper will slip. It is necessary for the paper to go around at least one revolution before the paper relaxes onto the drum in the appropriate shape, after which the voltage could be lowered. However, by pre-curling the paper with the rollers 244 and 246, this is alleviated. This precurl operation is achieved by using slightly different durometers for the rollers 244 and 246.

The fuser 100 incorporates two rollers 256 and 258, the roller 258 being the heated roller and the roller 256 being the mating roller to form a nip therebetween. When the stripper arm 248 strips the paper off of the surface of the drum 248, this paper is routed into the nip between the rollers 258 and 256. The durometers of the rollers 258 and 256 are selected such that the roller 256 is softer than the roller 258 and such that the paper will tend to curl around the roller 258, thus providing a "decurl" to the paper to allow the paper to again flatten out. The durometer of the roller 256 is approximately 30 mms and the durometer of the roller 258 is approximately 40 mms. The paper is then forwarded to either a transfer path 260 or a transfer path 262. The transfer path 260 feeds to the nip between two rollers 264 and 266 for output onto the platform 118. The paper path 262 is routed to the nip between two rollers 268 and 270 for output to an external tray. In addition, as is well known in the art, the paper will tend to curl toward the surface of the fused toner, which is opposite the precurl direction. Therefore, fuser roller durometer need not fully compensate for the precurl operation.

As shown in FIG. 30, toner module 72 is the three color module containing all the required components for development of the color electrostatic latent image on the photoconductor. It is shown as a single inseparable unit to facilitate user handling and is separate from the black module 78, so that the black materials can be handled identically to a black and white only print engine. Furthermore, the color module uses a mechanism to withdraw the developer brush such that the entire unit does not need to be moved, thereby reducing the space and power required to operate the unit.

Figure 31:
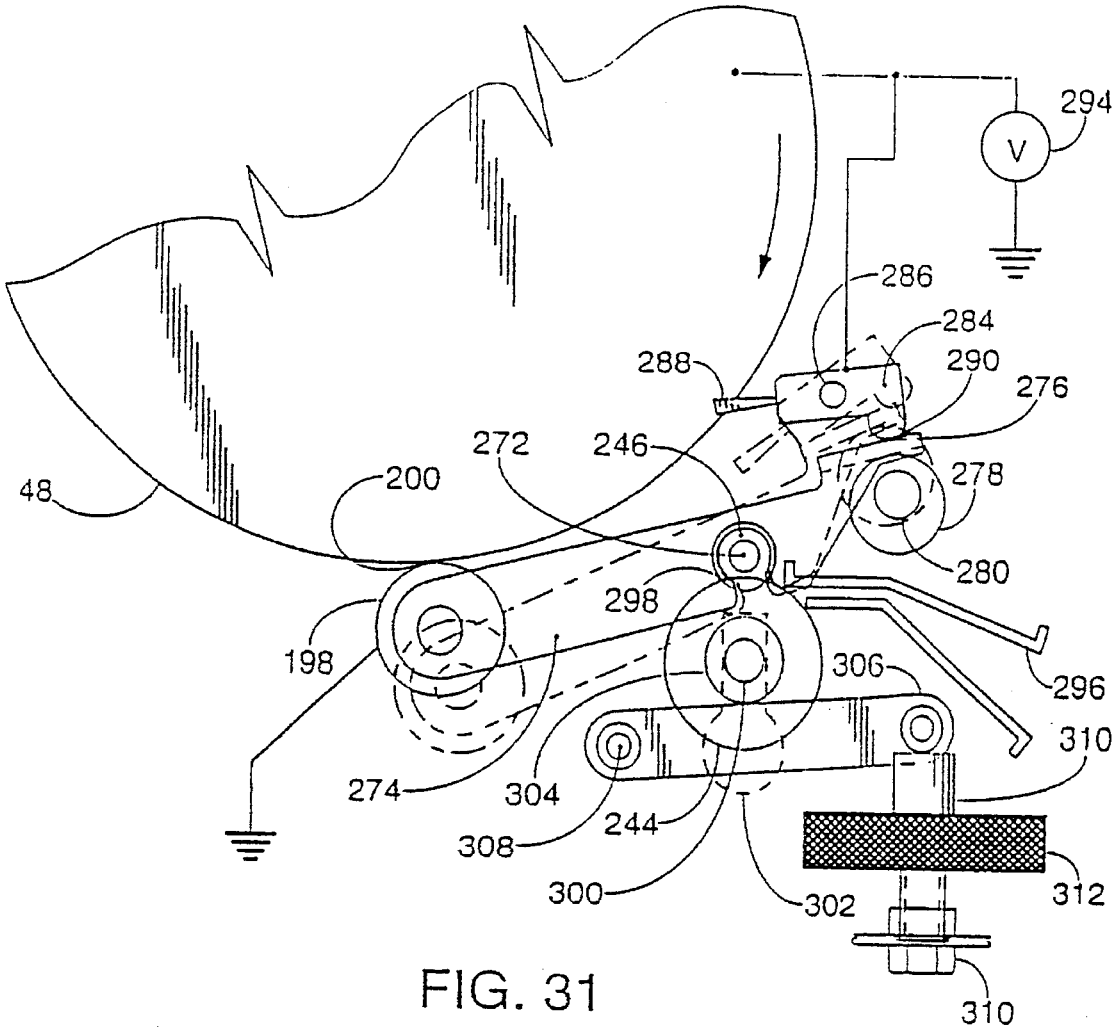
FIG. 31 illustrates a detail of the precurl device.

Referring now to FIG. 31, there is illustrated a detail of the precurl system. A bracket (not shown) is operable to hold a pivot pin 272 about which a pivoting arm 274 pivots. The arm 274 has attached to a distal end thereof the attach electrode roller 198, with a protruding portion 276 on the diametrically opposite side of the pin 272 from the electrode roller 198 operable to interface with a cam 278. The cam 278 is operable to pivot about a fixed pivot point 280 on the bracket (not shown) to pivot the arm 274.

The arm 274 is operable to be pivoted into two positions, a first position wherein the attach electrode roller 198 contacts the drum 48, and the second position (shown in phantom line) which pulls the attach electrode roller 198 away from the drum. A discharge electrode 284 is pivoted about a pivot pin 286 and has an electrode brush 288 disposed on one end thereof. The discharge electrode 284 is operable to pivot in one position such that the electrode brush 288 contacts the surface of the drum 248 to provide a discharge operation prior to the surface of the drum rotating into contact with the nip 200 and, in the second position, to be pivoted away from the surface of the drum 48. The protrusion 290 on the rear portion of the electrode 284 is operable to interface with the protrusion 276 on the pivoting arm 274. The discharge electrode 284 is spring-loaded (not shown) such that it is biased toward the surface of the drum 48 to contact the drum 48, such that when the pivoting arm 274 pivots to move the protrusion 276 away from the protrusion 290, the electrode brush 288 will pivot into contact with the drum 48. When the pivoting arm 274 pivots counterclockwise to move the attach electrode 198 away from the surface of the drum 48, the protrusion 276 urges the protrusion 290 up and pivots the electrode 284 and the electrode brush 288 away from the surface of the drum 48. The discharge electrode 288 is connected to the same attach/transfer voltage supply, a supply 294, that the buried electrode layer of drum 48 is connected to.

The paper is fed into a paper path 296, which paper path is comprised of two narrowing flat surfaces that direct the paper. The paper is directed to a nip 298 between the rollers 244 and 246. The roller 246 pivots about the pivot pin 272 and the roller 242 pivots about a slidable pin 300. The pin 300 slides in a slot 302 which is disposed in the bracket (not shown). The roller 244 has a durometer that is softer than the durometer of the soft roller 246 such that the paper will tend to roll around the roller 246. The size of the rollers 244 and 246 can be selected to determine the amount of precurl required. Further, the durometers of the two rollers 244 and 246 can also be selected in order to accommodate various thicknesses and weights of paper. In one embodiment, the durometer of roller 244 is 20 mms, and the roller 246 is a rigid material such as steel. As such, a given size relationship between-the rollers 244 and 246 and a given durometer relationship therebetween for a set force therebetween will not necessarily insure the appropriate precurl. If the attachment voltage on the drum 48 is reduced to as low a level as possible, this precurl adjustment may be critical to insure that the paper adequately adheres to the surface of the drum 48 for all weights of paper. To facilitate an adjustment to this, the roller 244 has a collar 304 disposed on one end thereof that is rotatable with the roller 244 about pivot pin 300 and the collar 304 interacts with a lever 306. Lever 306 is pivoted at one end to a fixed pivot pin 308 and, at the other end, rests on the end of a piston 310. The piston 310 has a threaded end on the opposite end from the lever 306 which is threadedly engaged with a nut 310 that is secured in the frame. An adjustment wheel 312 is disposed about the piston 310 to allow hand adjustment thereof. In this manner, the pin 300 can be reciprocated within the slot 302. It should be noted that the pin 300 is biased downward against the lever by a spring attachment (not shown).

Figure 31A:
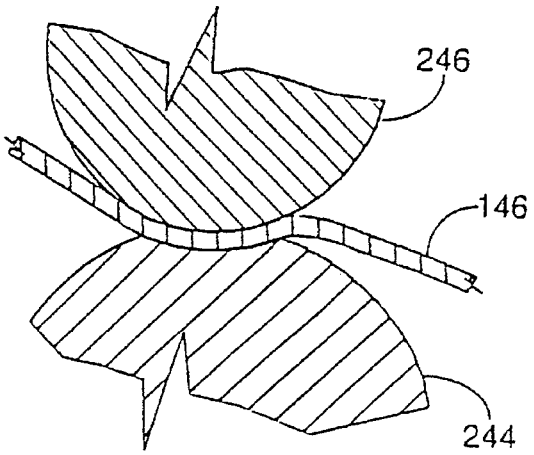
FIG. 31*a* illustrates a detail of the precurl operation for the precurl rollers.

Referring now to FIG. 31A, there is illustrated a detail of the precurl operation for the rollers 244 and 246. It can be seen that the paper is precurled by the deformation of the roller 244 such that the paper retains a memory of the curling operation. Thus, when the paper is fed to the attach nip 200, the paper will exhibit less of a normal force directed away from the surface of the drum 48.

As shown in FIGS. 30 and 31, a mechanism comprised of a conductive roll is employed to urge the paper against the BED surface. Although this is the preferred embodiment, it is envisioned that a lower cost alternative would be to use the photoconductor itself as the initial member to urge the paper against the BED surface. This would eliminate the need for the moving member 274 as shown in FIG. 31.

It has been noted that in order to grip paper to a drum or curved surface electrostatically, that the electrostatic gripping forces must be sufficient to overcome the inherent stiffness of the paper. Specifically, the greater the stiffness of the paper, the higher is the electrostatic gripping force and associated voltage to achieve that force. In order to use a single voltage to transfer and grip, the gripping voltage must be reduced for stiffer papers so that the transfer voltage exceeds the minimum voltage threshold for gripping.

Numerous papers have been tested to determine their inherent stiffness and ability to be permanently curled in a hard/soft roller combination. As a result of this testing, it has been determined that there is a minimum threshold of paper deflection that must occur in a precurl system to ensure all materials will be adequately gripped onto the drum. Furthermore, in order to minimize unnecessary curl in paper, this threshold can be adjusted by a predetermined amount and still achieve satisfactory gripping.

Figure 32A:
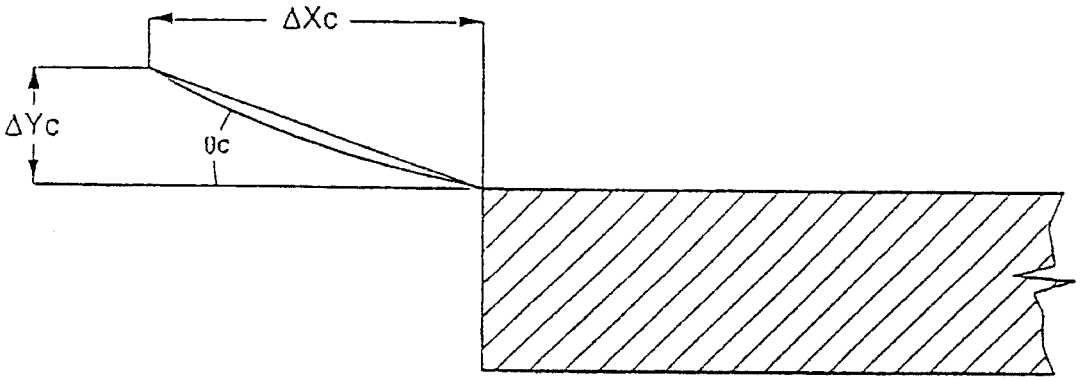
FIGS. 32*a* and 32*b* illustrate devices to measure paper droop and curl.
Figure 32B:
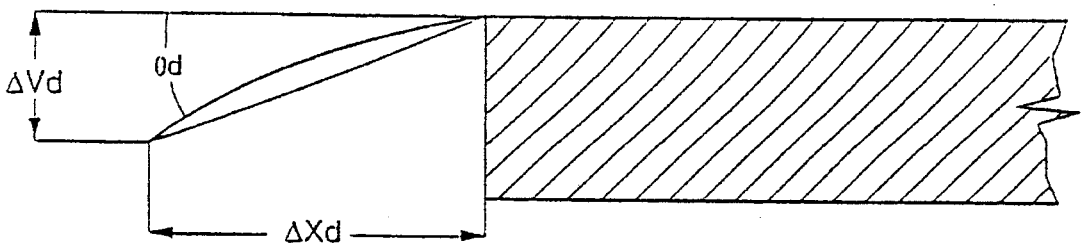
Figure 33:
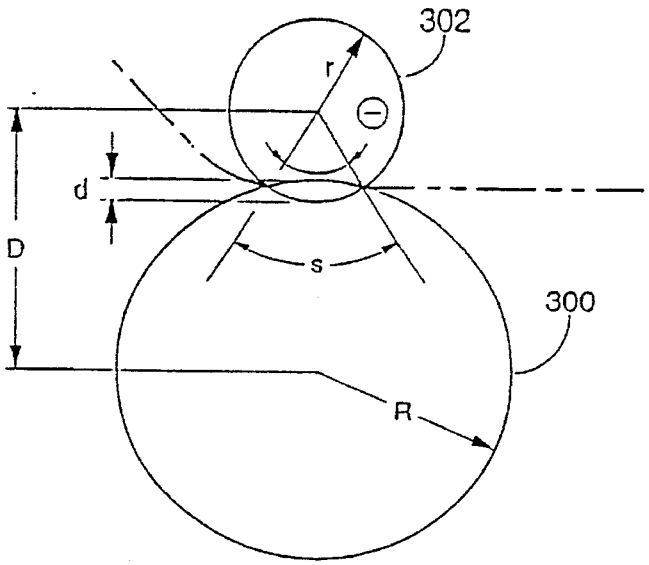
FIG. 33 illustrates a view of the precurl rollers.

FIG. 32*a* shows a method to measure the permanent curl or set that occurs in paper after it has been run through the precurling apparatus as shown in FIG. 33. The angle of curl ($\Theta_c$) is used to determine the paper's curl characteristic. It was determined by measuring the height off a flat surface that the precurled paper rises. Conversely, some papers are inherently very flexible and do not require precurling to reduce the electrostatic gripping force. FIG. 32*b* shows a method to measure the stiffness (or flexibility) of the paper. In this method, the paper is allowed to droop unsupported over a fixed length and the angle of repose (droop angle) is measured ($\Theta_d$).

If these angles are summed, then a figure of merit, M, is provided for paper where the value of M increases for papers that are easier to grip and require less precurl. The figure of merit, "M", is the sum of the paper's stiffness ("Droop Angle", $\Theta_d$) and its ability to be curled ("Curl Angle", $\Theta_c$):

$$M = k[\text{Tan}\ \theta_c) + (\text{Tan}\ \theta_d)] = k\left[\left(\frac{\Delta Y_c}{\Delta X_c}\right) + \frac{\Delta Y_d}{\Delta X_d}\right)\right] \quad (13)$$

Where k is a constant value determined to "normalize" a standard paper. The values $Y_c$, $X_c$, $Y_d$, and $X_d$ are determined from measurements taken from the curl and droop experiments.

Table 3 shows a chart of popular paper types in order of figure of merit. The figure of merit has been normalized to a value of 10 for a widely used paper type in laser printers. Tables 4 and 5 illustrate results of curl and droop experiments for the assortment of papers.

TABLE 3

| | | Curl | | Droop | | |
|---|---|---|---|---|---|---|
| Paper Type | Weight (lb.) | $Y_c$ (mm) | $X_c$ (mm) | $Y_d$ (mm) | $X_d$ (mm) | M |
| Paper Type 1 | 28 | 10.0 | 48.4 | 7.5 | 79.0 | 8.0 |
| Paper Type 2 | 20 | 9.3 | 46.8 | 9.5 | 78.0 | 8.5 |
| Paper Type 3 | 24 | 12.3 | 47.8 | 9.5 | 78.0 | 10.0 |
| Paper Type 4 | 21 | 12.7 | 49.6 | 9.5 | 78.0 | 10.0 |
| Paper Type 5 | 20 | 3.9 | 24.6 | 18.5 | 76.5 | 10.6 |
| Paper Type 6 | 18 | 12.6 | 53.8 | 15.0 | 77.0 | 11.3 |
| Paper Type 7 | 20 | 17.0 | 51.4 | 10.0 | 78.0 | 12.1 |
| Paper Type 8 | 18 | 1.7 | 12.4 | 27.5 | 74.0 | 13.4 |
| Paper Type 9 | 13 | 1.6 | 16.2 | 31.0 | 73.0 | 13.8 |

TABLE 4

| | | | | | |
|---|---|---|---|---|---|
| Large Roller Radius, R (mm): | 12.5 | 12.5 | 12.5 | 12.5 | 12.5 |
| Small Roller Radius, r (mm): | 5.0 | 5.0 | 5.0 | 5.0 | 5.0 |
| Roller Interference, d (mm): | 0.5 | 1.0 | 1.5 | 2.0 | 2.5 |
| Center-to-Center Dist, D (mm): | 17.0 | 16.5 | 16.0 | 15.5 | 15.0 |
| Nip Angle, theta (deg): | 8.6 | 12.0 | 14.5 | 16.5 | 18.2 |
| Nip Width, S (mm): | 1.9 | 2.7 | 3.4 | 4.0 | 4.5 |

TABLE 5

| | Curl Angle + Droop Angle (deg) | | | | |
|---|---|---|---|---|---|
| theta/r (deg/mm): | 1.7 | 2.4 | 2.9 | 3.3 | 3.6 |
| Paper Type | | | | | |
| Paper Type 1 | 5.4 | 12.0 | 17.1 | 20.3 | 23.3 |
| Paper Type 2 | 11.4 | 18.1 | 18.2 | 21.0 | 22.3 |
| Paper Type 3 | 10.2 | 14.8 | 21.4 | 24.1 | 24.1 |
| Paper Type 4 | 11.5 | 13.8 | 21.3 | 23.4 | 24.1 |

TABLE 5-continued

| | Curl Angle + Droop Angle (deg) | | | | |
|---|---|---|---|---|---|
| Paper Type 5 | 23.6 | 21.3 | 22.6 | 22.8 | 22.6 |
| Paper Type 6 | 18.5 | 20.3 | 24.2 | 25.1 | 25.3 |
| Paper Type 7 | 10.9 | 19.0 | 25.6 | 27.1 | 26.7 |
| Paper Type 8 | 26.0 | 27.1 | 28.2 | 28.1 | 27.5 |
| Paper Type 9 | 29.4 | 29.3 | 28.6 | 29.6 | 30.6 |

FIG. 33 illustrates the precurl configuration of a soft roller 300 and hard roller 302 that deflects paper through a subtended angle Θ (nip angle). The radius of curvature, r, of the hard roller along with the nip angle, Θ, as caused by the interference with the soft roller radius, R, determines the amount of curl. Tables 4 and 5 illustrate the result of the precurl function combined with the stiffness of the paper versus the nip angle by radius of curvature quotient for various paper types. It is interesting to note that the some materials show little change as a function of O/r. This is due to the fact that these materials are observed to be very flexible and require no precurl to grip, (i.e., they are always above the threshold). Of particular interest is the fact that for good performance for all paper types tested a minimum threshold of 2.9 degrees per millimeter or 15 degrees curl plus droop angle is required. If it is desired to reduce or increase the amount of curl for different media then the appropriate Θ/r can be determined by selecting the curl droop angle sum to be above 15 degrees.

It should be noted that the threshold of curl plus droop may increase to the fourth power of the proportionately to the decrease of the radius of curvature. For example, the gripping threshold for a drum radius of 65 millimeters (the above threshold is for 70 millimeters) would increase by 34% (or $(70/65)^4$) to 20 degrees (3.3 degrees/mm for the stiffest material tested).

Although the preferred embodiment has been described in detail, it should be understood that various changes, substitutions and alterations can be made therein without departing from the spirit and scope of the invention as defined by the appended claims.

What is claimed is:

1. An electrophotographic print engine having a transfer mechanism for transferring an image from a photoconductor member to a flexible image receiving member, the transfer mechanism comprising:

a rotating supporting member having a substantially continuous surface for carrying the flexible image receiving member on the surface thereof;

a rotating device for rotating said support member;

an electrostatic surface disposed on the surface of said rotating support member, the flexible receiving member electrostatically adhered to said electrostatic surface when the voltage across said electrostatic surface and the flexible image receiving member exceed a predetermined gripping voltage;

a reference voltage source for applying a reference voltage level to the photoconductor member;

a transfer nip formed between the photoconductor member and said electrostatic surface; and a primary voltage source for applying a primary voltage level across said electrostatic surface and the flexible image receiving member at said transfer nip and relative to said reference voltage being source level that is equal to or greater than the sum of said gripping voltage and at least a transfer voltage, said transfer voltage necessary to transfer toner across said transfer nip from said photoconductor member to the flexible image receiving member, which said primary voltage source operates in conjunction with said electrostatic surface to allow the voltage across said electrostatic surface and the flexible image receiving member to decay after passing through said transfer nip downward from said primary voltage level to a voltage greater than or equal to said gripping voltage level but less than said primary voltage level by at least said transfer voltage level prior to entering said transfer nip before the next transfer process.

2. The electrophotographic print engine of claim 1, wherein said primary voltage source comprises a single voltage source.

3. The electrophotographic print engine of claim 2, wherein said rotating support member is conductive and said primary voltage source is applied to said rotating support member.

4. The electrophotographic print engine of claim 3, wherein said rotating support member is cylindrical.

5. The electrophotographic print engine of claim 1, and further comprising means for attaching the flexible image receiving member to said electrostatic surface.

6. The electrophotographic print engine of claim 5, and further comprising:

an attachment device for urging the flexible image receiving member against said electrostatic surface at a point on the surface of said electrostatic surface;

an attachment voltage source for applying an attachment voltage level to the surface of the flexible image receiving member, such that the voltage difference between the primary voltage source and said attachment voltage source is applied across a combination of the flexible image receiving member and said electrostatic surface.

7. A method for transferring an image from a photoconductor member to a flexible image receiving member, comprised in steps of:

providing a rotating support member for carrying the flexible image receiving member proximate the surface thereof;

rotating the support member;

disposing an electrostatic surface on the surface of the support member, the flexible image receiving member electrostatically adhered to the surface of the electrostatic surface when the voltage across the electrostatic surface and the flexible image receiving member is greater than a predetermined gripping voltage level;

applying a reference voltage level to the photoconductor member;

forming a transfer nip between the photoconductor member and the electrostatic surface; and applying a primary voltage level proximate to the bottom surface of the electrostatic surface and the flexible image receiving member at the transfer nip and relative to the reference voltage source that is equal to or greater than the sum of the gripping voltage level and at least a transfer voltage level, the transfer voltage level being the voltage level necessary to transfer toner across the transfer nip from the photoconductor member to the flexible image receiving member when disposed on the electrostatic surface, which primary voltage source operates in conjunction with the electrostatic surface to allow the voltage across the electrostatic surface and the flexible image receiving member to decay after passing through the transfer nip from the primary voltage level to a voltage level that is greater than or equal to the gripping voltage level but less than the primary voltage level by at least the transfer voltage level prior to entering the transfer nip.

* * * * *

UNITED STATES PATENT AND TRADEMARK OFFICE

CERTIFICATE OF CORRECTION

PATENT NO. : 5,583,623

DATED : December 10, 1996

INVENTOR(S) : Bartholmae et al.

It is certified that error appears in the above-indentified patent and that said Letters Patent is hereby corrected as shown below:

Column 1, before "CROSS REFERENCE TO RELATED APPLICATION", insert

--TECHNICAL FIELD OF THE INVENTION

The present invention pertains in general to electrophotographic machines, and more particularly, to the transfer medium, such as the drum or transfer belt.--;

Column 3, line 29, delete (second occurrence) "29", and insert therefor --28--;

Column 7, line 24, delete "feed", and insert therefor --fed--;

Column 8, line 8, delete "composed", and insert therefor --comprised--;

Column 17, line 8, delete (second occurrence) "248", and insert therefor --48--;

Column 20, line 18, delete "the";

Column 20, line 19, delete "O/r", and insert therefor --Θ/r--;

UNITED STATES PATENT AND TRADEMARK OFFICE

CERTIFICATE OF CORRECTION

PATENT NO. : 5,583,623

DATED : December 10, 1996

INVENTOR(S) : Bartholmae et al

It is certified that error appears in the above-indentified patent and that said Letters Patent is hereby corrected as shown below:

Claim 1, column 20, line 64, delete "being";

Claim 1, column 20, line 67, before "necessary", insert --being--.

Signed and Sealed this

Fourteenth Day of October, 1997

*Attest:*

Bruce Lehman

BRUCE LEHMAN

*Attesting Officer*

*Commissioner of Patents and Trademarks*